US010292894B2

(12) United States Patent
Wright et al.

(10) Patent No.: US 10,292,894 B2
(45) Date of Patent: May 21, 2019

(54) COMPRESSION THERAPY DEVICE AND COMPRESSION THERAPY PROTOCOLS

(71) Applicant: TACTILE SYSTEMS TECHNOLOGY, INC., Minneapolis, MN (US)

(72) Inventors: Carol Lynn Wright, Pittsburgh, PA (US); Gregory Yurko, Murrysville, PA (US)

(73) Assignee: TACTILE SYSTEMS TECHNOLOGY, INC., Minneapolis, MN (US)

( * ) Notice: Subject to any disclaimer, the term of this patent is extended or adjusted under 35 U.S.C. 154(b) by 643 days.

(21) Appl. No.: 14/619,660

(22) Filed: Feb. 11, 2015

(65) Prior Publication Data

US 2015/0224012 A1 Aug. 13, 2015

Related U.S. Application Data

(60) Provisional application No. 61/938,514, filed on Feb. 11, 2014.

(51) Int. Cl.
*A61H 9/00* (2006.01)

(52) U.S. Cl.
CPC ..... *A61H 9/0078* (2013.01); *A61H 2201/164* (2013.01); *A61H 2201/1614* (2013.01);
(Continued)

(58) Field of Classification Search
CPC ..... A61H 9/00; A61H 9/005; A61H 9/0078
See application file for complete search history.

(56) References Cited

U.S. PATENT DOCUMENTS 3,811,431 A 5/1974 Apstein
4,011,860 A 3/1977 Lee
(Continued)

FOREIGN PATENT DOCUMENTS

DE 19846922 A1 4/2000
FR 2682279 A1 4/1993
(Continued)

OTHER PUBLICATIONS

Extended European Search Report for EP 13760396 dated Sep. 30, 2015.
(Continued)

*Primary Examiner* — Timothy A Stanis
(74) *Attorney, Agent, or Firm* — Mueting, Raasch & Gebhardt, P.A.

(57) ABSTRACT

A compression therapy device may include a compression therapy appliance comprising a number of independently inflatable cells and a controller to control a flow of a pressurizing fluid into and out of each cell via a number of valves. The controller may direct the valves to inflate or deflate each cell in a sequence according to one or more compression therapy protocols. The compression therapy appliance may be placed on a portion of a patient's body to provide compression therapy according to one or more of the compression therapy protocols. The portion of the patient's body in contact with the compression therapy appliance may include a proximal end and a distal end. A compression therapy protocol may include alternating inflation and deflation steps of one or more cells placed in contact with the proximal end of the patient's body, thereby improving fluid flow into the proximal end of the patient.

17 Claims, 12 Drawing Sheets

(52) U.S. Cl.
CPC ..... *A61H 2201/1619* (2013.01); *A61H 2201/1628* (2013.01); *A61H 2201/1635* (2013.01); *A61H 2201/50* (2013.01); *A61H 2201/501* (2013.01); *A61H 2201/5035* (2013.01); *A61H 2201/5041* (2013.01); *A61H 2201/5046* (2013.01); *A61H 2201/5071* (2013.01); *A61H 2209/00* (2013.01); *A61H 2230/207* (2013.01); *A61H 2230/30* (2013.01)

(56) References Cited

U.S. PATENT DOCUMENTS

| | | | | |
|---|---|---|---|---|
| 4,013,069 | A | 3/1977 | Hasty | |
| 4,086,920 | A | 5/1978 | Miniere | |
| 4,338,923 | A | 7/1982 | Gelfer et al. | |
| 4,424,806 | A | 1/1984 | Newman et al. | |
| 4,762,121 | A | 8/1988 | Shienfeld | |
| 4,773,397 | A | 9/1988 | Wright et al. | |
| 4,865,020 | A | 9/1989 | Bullard | |
| 4,922,893 | A | 5/1990 | Wright et al. | |
| 5,014,681 | A * | 5/1991 | Heeman | A61H 9/0078 128/DIG. 20 |
| 5,092,317 | A | 3/1992 | Zelikovski | |
| 5,117,812 | A | 6/1992 | McWhorter | |
| 5,179,941 | A | 1/1993 | Siemssen et al. | |
| 5,186,163 | A | 2/1993 | Dye | |
| 5,263,473 | A | 11/1993 | McWhorter | |
| 5,307,791 | A | 5/1994 | Senoue et al. | |
| 5,383,842 | A | 1/1995 | Bertini | |
| 5,437,610 | A | 8/1995 | Cariapa et al. | |
| 5,496,262 | A | 3/1996 | Johnson, Jr. et al. | |
| 5,554,103 | A | 9/1996 | Zheng et al. | |
| 5,571,075 | A | 11/1996 | Bullard | |
| 5,575,762 | A | 11/1996 | Peeler et al. | |
| 5,584,798 | A | 12/1996 | Fox | |
| 5,588,955 | A | 12/1996 | Johnson, Jr. et al. | |
| 5,591,200 | A | 1/1997 | Cone et al. | |
| 5,795,312 | A | 8/1998 | Dye | |
| 5,830,164 | A | 11/1998 | Cone et al. | |
| 5,840,049 | A | 11/1998 | Tumey et al. | |
| 5,843,007 | A | 12/1998 | McEwen et al. | |
| 5,891,065 | A | 4/1999 | Cariapa et al. | |
| 5,951,502 | A | 9/1999 | Peeler et al. | |
| 5,968,073 | A | 10/1999 | Jacobs | |
| 6,007,559 | A | 12/1999 | Arkans | |
| 6,010,471 | A | 1/2000 | Ben-Noon | |
| 6,080,120 | A | 6/2000 | Sandman et al. | |
| 6,123,681 | A | 9/2000 | Brown, III | |
| 6,129,688 | A | 10/2000 | Arkans | |
| 6,135,116 | A | 10/2000 | Vogel et al. | |
| 6,179,796 | B1 | 1/2001 | Waldridge | |
| 6,231,532 | B1 | 5/2001 | Watson et al. | |
| 6,234,532 | B1 | 5/2001 | Watson et al. | |
| 6,290,662 | B1 | 9/2001 | Morris et al. | |
| 6,296,617 | B1 | 10/2001 | Peeler et al. | |
| 6,315,745 | B1 | 11/2001 | Kloecker | |
| 6,406,445 | B1 | 6/2002 | Ben-Nun | |
| 6,436,064 | B1 | 8/2002 | Kloecker | |
| 6,440,093 | B1 | 8/2002 | McEwen et al. | |
| 6,494,852 | B1 | 12/2002 | Barak et al. | |
| 6,544,202 | B2 | 4/2003 | McEwen et al. | |
| 6,558,338 | B1 | 5/2003 | Wasserman | |
| 6,585,669 | B2 | 7/2003 | Manor et al. | |
| 6,645,165 | B2 | 11/2003 | Waldridge et al. | |
| 6,736,787 | B1 | 5/2004 | McEwen et al. | |
| 6,786,879 | B1 | 9/2004 | Bolam et al. | |
| 6,846,295 | B1 | 1/2005 | Ben-Nun | |
| 6,852,089 | B2 | 2/2005 | Kloecker et al. | |
| 6,860,862 | B2 | 3/2005 | Waldridge et al. | |
| 6,884,255 | B1 | 4/2005 | Newton | |
| 6,893,409 | B1 | 5/2005 | Lina | |
| 6,945,944 | B2 | 9/2005 | Kuiper et al. | |
| 6,966,884 | B2 | 11/2005 | Waldridge et al. | |
| 7,048,702 | B2 | 5/2006 | Hui | |
| 7,074,200 | B1 | 7/2006 | Lewis | |
| 7,063,676 | B2 | 8/2006 | Barak et al. | |
| 7,398,803 | B2 | 7/2008 | Newton | |
| 7,637,879 | B2 | 12/2009 | Barak et al. | |
| 7,846,114 | B2 | 12/2010 | Webster et al. | |
| 7,862,525 | B2 | 1/2011 | Carkner et al. | |
| 8,182,437 | B2 | 5/2012 | Gasbarro et al. | |
| 8,202,236 | B2 | 6/2012 | Gasbarro | |
| 2002/0091345 | A1 | 7/2002 | Hazard | |
| 2003/0208465 | A1 | 11/2003 | Yurko et al. | |
| 2004/0059274 | A1 | 3/2004 | Kloecker et al. | |
| 2004/0171971 | A1 | 9/2004 | Ravikumar et al. | |
| 2004/0261182 | A1 | 12/2004 | Biggie et al. | |
| 2005/0154336 | A1 | 7/2005 | Kloecker et al. | |
| 2005/0222526 | A1 | 10/2005 | Perry et al. | |
| 2006/0161081 | A1 | 7/2006 | Barak et al. | |
| 2006/0272719 | A1 | 12/2006 | Steinberg | |
| 2007/0049853 | A1 | 3/2007 | Adams et al. | |
| 2007/0088239 | A1 | 4/2007 | Roth et al. | |
| 2007/0249976 | A1 | 10/2007 | Tucker et al. | |
| 2007/0272250 | A1 | 11/2007 | Lewis | |
| 2008/0281240 | A1 | 11/2008 | Wright et al. | |
| 2009/0007341 | A1 | 1/2009 | Roff et al. | |
| 2009/0056020 | A1 | 3/2009 | Caminade et al. | |
| 2009/0145234 | A1 | 6/2009 | Gasbarro et al. | |
| 2010/0042026 | A1* | 2/2010 | Kloecker | A61F 5/34 601/149 |
| 2012/0065561 | A1 | 3/2012 | Ballas et al. | |
| 2012/0219432 | A1 | 8/2012 | Wright et al. | |
| 2012/0277636 | A1 | 11/2012 | Blondheim et al. | |
| 2013/0125613 | A1 | 5/2013 | Grotov | |
| 2013/0237889 | A1 | 9/2013 | Wright et al. | |
| 2013/0331748 | A1 | 12/2013 | Wright et al. | |
| 2014/0052028 | A1 | 2/2014 | Wright et al. | |
| 2015/0150746 | A1 | 6/2015 | Yurko et al. | |
| 2015/0202116 | A1 | 7/2015 | Wright | |

FOREIGN PATENT DOCUMENTS

| | | | |
|---|---|---|---|
| GB | 2313784 | A | 10/1997 |
| WO | WO 2005/082314 | A1 | 9/2005 |
| WO | WO 2007/074451 | A2 | 7/2007 |
| WO | WO 2009/076269 | A2 | 6/2009 |
| WO | WO 2013/138307 | A1 | 9/2013 |
| WO | WO 2014/031409 | A1 | 2/2014 |
| WO | WO 2015/084312 | A1 | 6/2015 |

OTHER PUBLICATIONS

Motorola, Integrated silicone Pressure Sensor On-Chip Signal Conditioned, Temperature Compensated and Calibrated; MPX5050 MPXV5050G Series, 2002.

* cited by examiner

COMPRESSION THERAPY DEVICE AND COMPRESSION THERAPY PROTOCOLS

CLAIM OF PRIORITY

This application claims benefit of and priority to U.S. Provisional Application No. 61/938,514 filed Feb. 11, 2014, entitled "Compression Therapy Device and Therapeutic Protocols," the disclosure of which is incorporated by reference herein in its entirety.

BACKGROUND

Diseases such as venous insufficiency and lymphedema can often result in the pooling of bodily fluids in areas of the body distal from the heart. Venous insufficiency occurs when the superficial veins of an extremity empty into the deep veins for example in the lower leg. Normally, the contractions of the calf muscles act as a pump, moving blood into the popliteal vein, which is the outflow vessel. Failure of this pumping action can occur as a result of muscle weakness, overall chamber size reduction, valvular incompetence, and/or outflow obstruction. Each of these conditions can lead to venous stasis and hypertension in the affected area. Lymphedema, which is swelling due to a blockage of the lymph passages, may be caused by lymphatic obstruction, a blockage of the lymph vessels that drain fluid from tissues throughout the body. This most commonly occurs as a result of cancer surgery, general surgery, tumors, radiation treatments, trauma and congenital anomalies. Lymphedema is a chronic condition that currently has no cure.

Fluid accumulation can be painful and debilitating if not treated. Fluid accumulation can reduce oxygen transport, interfere with wound healing, provide a medium that supports infections, or even result in the loss of a limb if left untreated.

Compression pumps are often used in the treatment of venous insufficiency to move the accumulated bodily fluids. Such pumps typically include an air compressor that blows air through tubes to an appliance such as a sleeve or boot containing a number of separately inflatable cells that is fitted over a problem area (such as an extremity or torso). Such pumps may also include pneumatic components adapted to inflate and exhaust the cells, and control circuitry governing the pneumatic components. A compression therapy protocol typically involves sequential inflation of the cells to a pre-set pressure in a distal to proximal order, followed by exhausting all the cells in concert.

While such a compression therapy device may be used in therapy for lymphedema, other pathologies, including venous insufficiency, venous return deficiency, arterial output insufficiencies, soft tissue injuries (for example due to athletic activities), and peripheral arterial disease, as well as the prevention of deep vein thrombosis, may be improved by the use of such a compressor device. The use of such a compression therapy device may improve local venous perfusion as well as systemic venous return. In one non-limiting example, coronary or arterial output may be improved as a result of improved venous return to the heart. However, a compression therapy protocol that may be useful for lymphedema may not be appropriate for other pathologies. Improved systems and methods for implementing and controlling a pneumatic compression therapy device to assist in a variety of compression therapy protocols would be desirable.

SUMMARY

Before the present methods, systems and materials are described, it is to be understood that this disclosure is not limited to the particular methodologies, systems and materials described, as these may vary. It is also to be understood that the terminology used in the description is for the purpose of describing the particular versions or embodiments only, and is not intended to limit the scope.

It must also be noted that as used herein and in the appended claims, the singular forms "a," "an," and "the" include plural references unless the context clearly dictates otherwise. Thus, for example, reference to a "valve" is a reference to one or more valves and equivalents thereof known to those skilled in the art, and so forth. Unless defined otherwise, all technical and scientific terms used herein have the same meanings as commonly understood by one of ordinary skill in the art. Although any methods, materials, and devices similar or equivalent to those described herein can be used in the practice or testing of embodiments, the preferred methods, materials, and devices are now described. All publications mentioned herein are incorporated by reference. Nothing herein is to be construed as an admission that the embodiments described herein are not entitled to antedate such disclosure by virtue of prior invention.

In an embodiment, a compression therapy device may include a source of a pressurized fluid via a source output, a sink for the pressurized fluid via a sink input, and one or more manifolds configured to be in fluid communication with one or more of the source output and the sink input. The pneumatic compression system may also include a compression therapy appliance configured to be placed in physical communication with at least a portion of a patient, in which the compression therapy appliance comprises a plurality of independently inflatable cells, including at least one proximal cell. The pneumatic compression system may further include a plurality of valves, in which each valve has a cell side and a manifold side, so that the manifold side of each of the plurality of valves is in fluid communication with at least one manifold, and the cell side of each of the plurality of valves is in fluid communication with one of the plurality of independently inflatable cells. Additionally, each of the plurality of valves may be in a first state when the cell side of the valve is in fluid communication with the source output, a second state when the cell side of the valve is in fluid communication with the sink input, and a third state when the cell side of the valve is not in fluid communication with either the source output or the sink input. A valve in the first state may thereby cause inflation of the inflatable cell in fluid communication with the valve, a valve in the second state may thereby cause deflation of the inflatable cell in fluid communication with the valve, and a valve in the third state may thereby cause an inflatable cell in fluid communication with the valve to maintain a fluid pressure. Additionally, the pneumatic compression system may incorporate a computing device in operable communication with each of the plurality of valves, in which the computing device comprises a non-transitory, computer-readable storage medium that contains one or more programming instructions that, when executed, cause the computing device to place each of the plurality of valves in the first state, thereby inflating each of the plurality of inflatable cells, place each of the plurality of valves in the third state, thereby maintaining a fluid pressure in each of the plurality of inflatable cells, place each of the plurality of valves in fluid communication with the at least one proximal cell in the second state, thereby deflating the at least one proximal cell, and cycle the state of each of the plurality of valves in fluid communication with the at least one proximal cell between the first state and the second state, thereby sequentially inflating and deflating the at least one proximal cell.

In an embodiment, a method of treating a portion of a human body for an edematous condition using a compression therapy device may include providing a compression therapy device comprising a compression therapy appliance, in which the compression therapy appliance comprises a plurality of independently inflatable cells comprising at least one proximal cell, contacting the compression therapy appliance with portion of the body, so that the at least one proximal cell is adjacent to a proximal portion of the body, causing, by the compression therapy device, at least a portion of the plurality of independently inflatable cells to assume an inflated state, causing, by the compression therapy device, the portion of the plurality of independently inflatable cells to maintain the inflated state, and causing, by the compression therapy device, the at least one proximal cell to cycle between the inflated state and a deflated state.

In an embodiment, a method of treating a portion of a human body for an edematous condition using a compression therapy device may include providing a compression therapy device comprising a compression therapy appliance, in which the compression therapy appliance comprises a plurality of independently inflatable cells arranged in a sequential order from a distal cell to a proximal cell, contacting the compression therapy appliance with the portion of the body, so that the proximal cell is adjacent to a proximal portion of the body and the distal cell is adjacent to a distal portion of the body, causing, by the compression therapy device, at least a first portion of the plurality of independently inflatable cells to assume an inflated state, causing, by the compression therapy device, the first portion of the plurality of independently inflatable cells to maintain the inflated state, causing, by the compression therapy device, the proximal cell to cycle between the inflated state and a deflated state, causing, by the compression therapy device, the plurality of cells to assume the deflated state, causing, by the compression therapy device, at least a second portion of the plurality of independently inflatable cells to assume an inflated state, causing, by the compression therapy device, the second portion of the plurality of independently inflatable cells to maintain the inflated state, and causing, by the compression therapy device, the proximal cell and at least one cell distal to the proximal cell to cycle between the inflated state and the deflated state.

BRIEF DESCRIPTION OF THE DRAWINGS

Aspects, features, benefits and advantages of the embodiments described herein will be apparent with regard to the following description, appended claims and accompanying drawings where:

DETAILED DESCRIPTION

Figure 1:
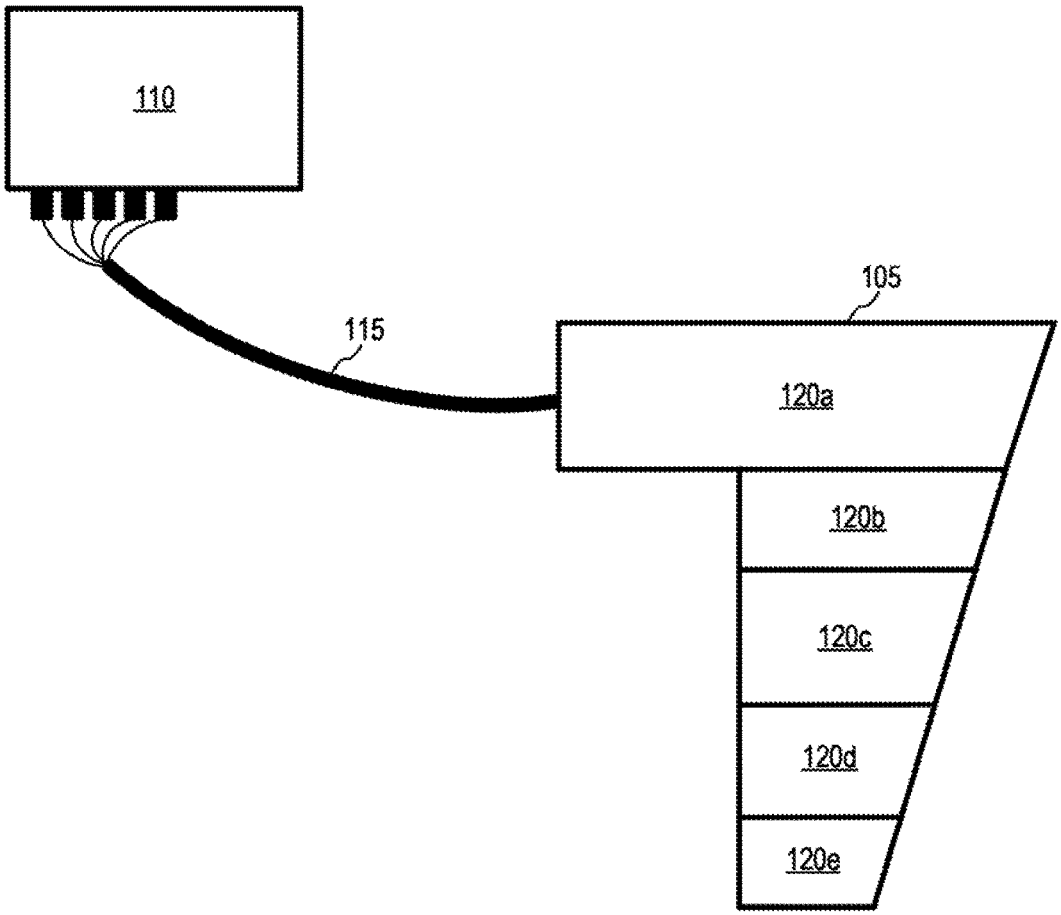
FIG. 1 depicts an illustrative compression therapy appliance according to an embodiment.

This disclosure is not limited to the particular systems, devices, and methods described, as these may vary. The terminology used in the description is for the purpose of describing the particular versions or embodiments only, and is not intended to limit the scope.

Nothing in this disclosure is to be construed as an admission that the embodiments described in this disclosure are not entitled to antedate such disclosure by virtue of prior invention. As used in this document, the term "comprising" means "including, but not limited to."

The following terms shall have, for the purposes of this application, the respective meanings set forth below.

As used herein, a "compression therapy appliance" is generally a garment-like appliance that provides pressure to at least a portion of a patient's body. A compression therapy appliance may take the form of any wearable garment including, but not limited to, a hat, a sleeve, a glove, a jacket, a vest, long pants, short pants, legging, a shoe, or a boot. A compression therapy appliance may be worn by the patient, placed adjacent to the patient, or attached to the patient. A compression therapy appliance generally contains one or more independently inflatable cells that, when inflated, provide the pressure to the portion of the patient's body.

As used herein, a "cell" is generally a sealed portion within a compression therapy appliance that is configured to inflate, maintain a pressure, and deflate. Those with ordinary skill in the art will recognize that a cell may generally be any compartment, bladder, bubble, and/or the like, as well as various portions thereof, that is configured to retain a fluid therein. A cell can include one or more valves or valve systems for inserting and/or removing the fluid from the cell. A cell may generally have any type of construction and may be made of any material. A cell may be configured to be a particular shape and/or size. A compression therapy appliance may incorporate one or more cells. Each of the cells in the compression therapy appliance may be independently inflated, deflated, or held at a static internal pressure.

As used herein, a "compression therapy protocol" is a sequence of steps to inflate, deflate, and maintain a pressure within one or more cells. A compression therapy protocol may include one or more steps defining which of a plurality of cells may be inflated, deflated, or maintained at a static pressure. A compression therapy protocol may also include one or more steps defining a duration of an inflation step, a deflation step, or a pressure maintenance step. A compression therapy protocol may further include one or more steps defining a pressure attained by one or more cells.

As used herein, the term "open," when referring to a valve or valve system, may be defined as a state of the valve or valve system in which a structure associated with a first side of the valve is placed in fluid communication with a structure associated with a second side of the valve.

As used herein, the term "closed," when referring to a valve or valve system, may be defined as a state of the valve or valve system in which a structure associated with a first side of the valve is not placed in fluid communication with a structure associated with a second side of the valve.

The described technology generally relates to compression therapy devices and protocols for operating the same. A compression therapy device may include a multi-chamber or multi-cell compression therapy appliance (e.g., a "compression sleeve" or "compression boot") configured to wrap around a portion of a patient's body. Non-limiting examples of a portion of a patient's body that may be treated with such a compression therapy appliance may include a torso, an abdomen, a shoulder, an arm, an upper arm, a hip, a leg, a thigh, a knee, and a foot. The cells of the compression therapy appliance may be independently pressurized (inflated) and de-pressurized (deflated) to move bodily fluids, such as edema fluids, interstitial fluids, and blood, within the portion of the patient's body receiving treatment to other parts of the body. Additionally, the cells of the compression therapy appliance may be independently maintained (held) at a static pressure for some period of time. The movement of fluids may be configured to treat various conditions associated with localized fluid retention, such as lymphedema, venous insufficiency, and prolonged wound healing.

Conventional compression therapy may be configured to apply sequential pressure along an extremity in a distal to proximal direction (for example, from the hand or foot toward the torso). In this manner, the therapy may produce a pressure gradient that forces fluid from a distal region in an extremity (for example, a hand) to a proximal region (for example, the torso). In some embodiments, compression therapy protocols may be configured to initially focus on the proximal area (for example, the torso) to "clear" the area thereby alleviating any local fluid "damming effects." Such a compression therapy protocol may be called a "decongesting" protocol. In this manner, the proximal area may be prepared to receive the fluids from the distal area when a sequential pressure protocol is applied in a distal to proximal direction along the extremity. In some embodiments, compression therapy protocols may be configured to prevent a reverse gradient and/or reverse flow of fluid within the extremity while stimulating the proximal area to decongest before implementing distal-to-proximal therapy of the extremity. It may be recognized that the use of compression therapy may also include the movement of fluids from one part of a torso to another. In a non-limiting example, edematous fluid in a chest area of a torso (the "distal" portion of the torso) may be moved by a sequential pressure protocol to the abdominal region of the torso (the "proximal" portion of the torso).

FIG. 1 depicts an illustrative compression therapy appliance (such as a sleeve 105) according to some embodiments. As shown in FIG. 1, a compression sleeve 105 may be configured to encase a limb, such as an arm or a leg. A patient may pull the sleeve 105 over or wrap the sleeve around a limb and may attach tubing 115 to a control device 110. In one non-limiting example, a plurality of independently inflatable cells 120*a-e* may be arranged in the compression therapy appliance in an ordered sequence. The independently inflatable cells 120*a-e* may be arranged from a proximal cell 120*a* to a distal cell 120*e*, with a plurality of medial cells 120*b-d* disposed therebetween. In one non-limiting example, a proximal cell 120*a* may be disposed at a proximal location of a patient, for example at a shoulder or the upper arm for a sleeve 105 appliance used for an arm. In one non-limiting example, a proximal cell 120*a* may be disposed at a proximal location of a patient, for example at a hip, waist, the groin, the upper thigh, or the abdomen for a sleeve 105 appliance used for a leg or foot. In another non-limiting example, a distal cell 120*e* may be disposed at a distal location of a patient, for example at a wrist or hand for a sleeve 105 appliance used for an arm. In still another non-limiting example, a distal cell 120*e* may be disposed at a distal location of a patient, for example at an ankle or foot for a sleeve 105 appliance used for a leg. In some embodiments, each cell 120*a-e* may be individually connected to the control device 110. The appliance may include individual cells 120*a-e* that may be selectively inflated by the control device 110 using a fluid (for example, water) or air. For example, the control device 110 may be configured to selectively pump fluid and/or air into the cells 120*a-e* to inflate the cells according to a compression therapy protocol (see FIGS. 5A-5G, below).

In some embodiments, the control device 110 may control the pressure of independently inflatable cells 120*a-e*. For instance, the independently inflatable cells 120*a-e* may be inflated to individual pressure values or ranges, such as greater pressures for more distal cells and lower pressures for more proximal cells or vice versa. The independently inflatable cells 120*a-e* may be inflated to any pressure capable of use in compression therapy using a compression therapy device. For example, the independently inflatable cells 120*a-e* may be inflated to a pressure of about 5 mmHg (about 0.667 kPa) to about 150 mmHg (about 20.0 kPa). In some non-limiting examples, independently inflatable cells 120*a-e* may be inflated to a pressure of about 5 mmHg (about 0.667 kPa), about 10 mmHg (about 1.33 kPa), about 15 mmHg (about 2.00 kPa), about 20 mmHg (about 2.67 kPa), about 25 mmHg (about 3.33 kPa), about 30 mmHg (about 4.00 kPa), about 50 mmHg (about 6.67 kPa), about 70 mmHg (about 9.33 kPa), about 100 mmHg (about 13.3 kPa), about 120 mmHg (about 16.0 kPa), about 130 mmHg (about 17.3 kPa), about 150 mmHg (about 20.0 kPa), and values and ranges between any two of these values (including endpoints).

Although 5 cells 120*a-e* are depicted in FIG. 1, embodiments are not so limited as the compression therapy appliance sleeve 105 may include more or fewer cells according to some embodiments. For example, the compression therapy appliance sleeve 105 may include 3 independently inflatable cells, 4 independently inflatable cells, 5 independently inflatable cells, 6 independently inflatable cells, 10 independently inflatable cells, 15 independently inflatable cells, 20 independently inflatable cells, 30 independently inflatable cells, 40 independently inflatable cells, and ranges between any two of these values (including endpoints). The independently inflatable cells 120*a-e* may be arranged in various configurations, including axially, longitudinally, circumferentially, in various patterns, and combinations thereof.

The compression therapy appliance sleeve 105 may be configured to provide compression therapy, for example as part of a decongestive therapy or a complete decongestive therapy (CDT) regimen. The compression therapy appliance sleeve 105 depicted in FIG. 1 may be configured for compression therapy of an arm, with proximal cell 120*a* being configured to be arranged about the torso, upper arm, or shoulder, and distal cell 120*e* being configured to be arranged about the hand, wrist, or forearm of a patient. A physician or other medical professional may program and/or download to the control device 110 one or more compression therapy protocols specifying the sequence of independently inflatable cell 120*a-e* inflation/deflation as well as the individual pressure of each inflated cell. For example, the control device 110 may be configured to implement the protocols illustrated in FIGS. 5A-5G and/or variations thereof. In this manner, a patient may receive effective and individualized treatment for a medical condition, such as lymphedema or other edematous conditions.

Figure 2A:
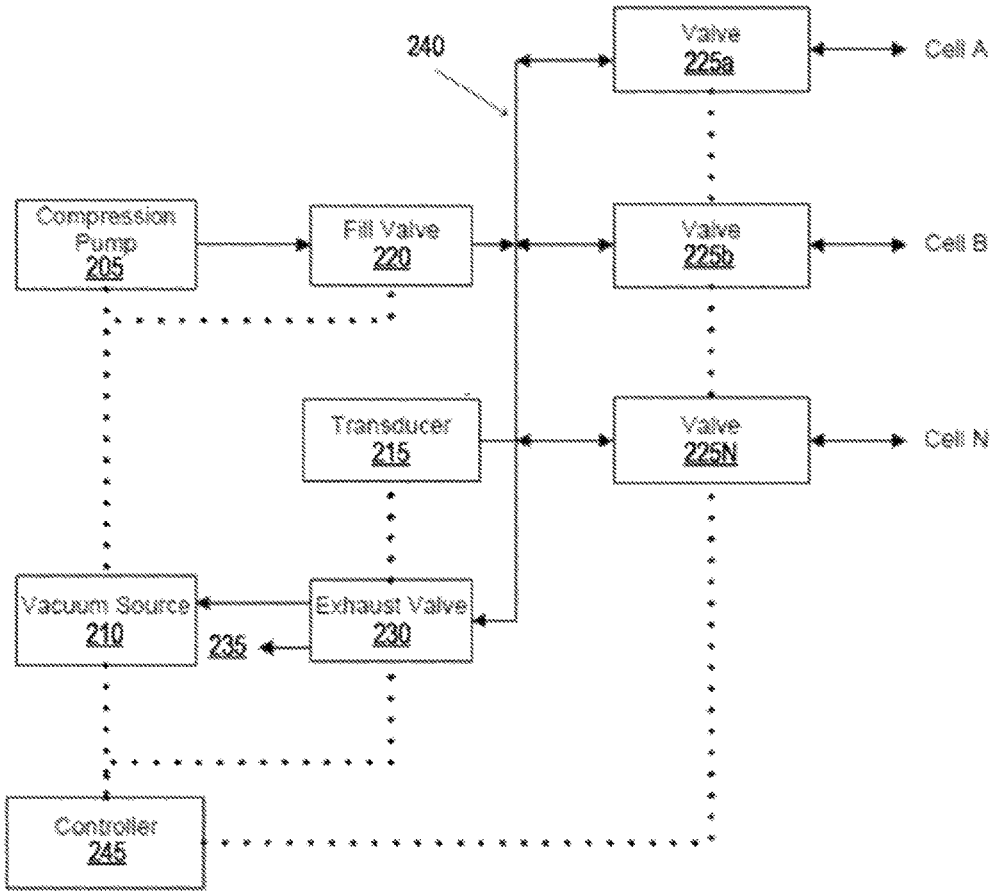
FIGS. 2A and 2B depict an illustrative pneumatic compression therapy device according to some embodiments.
Figure 2B:
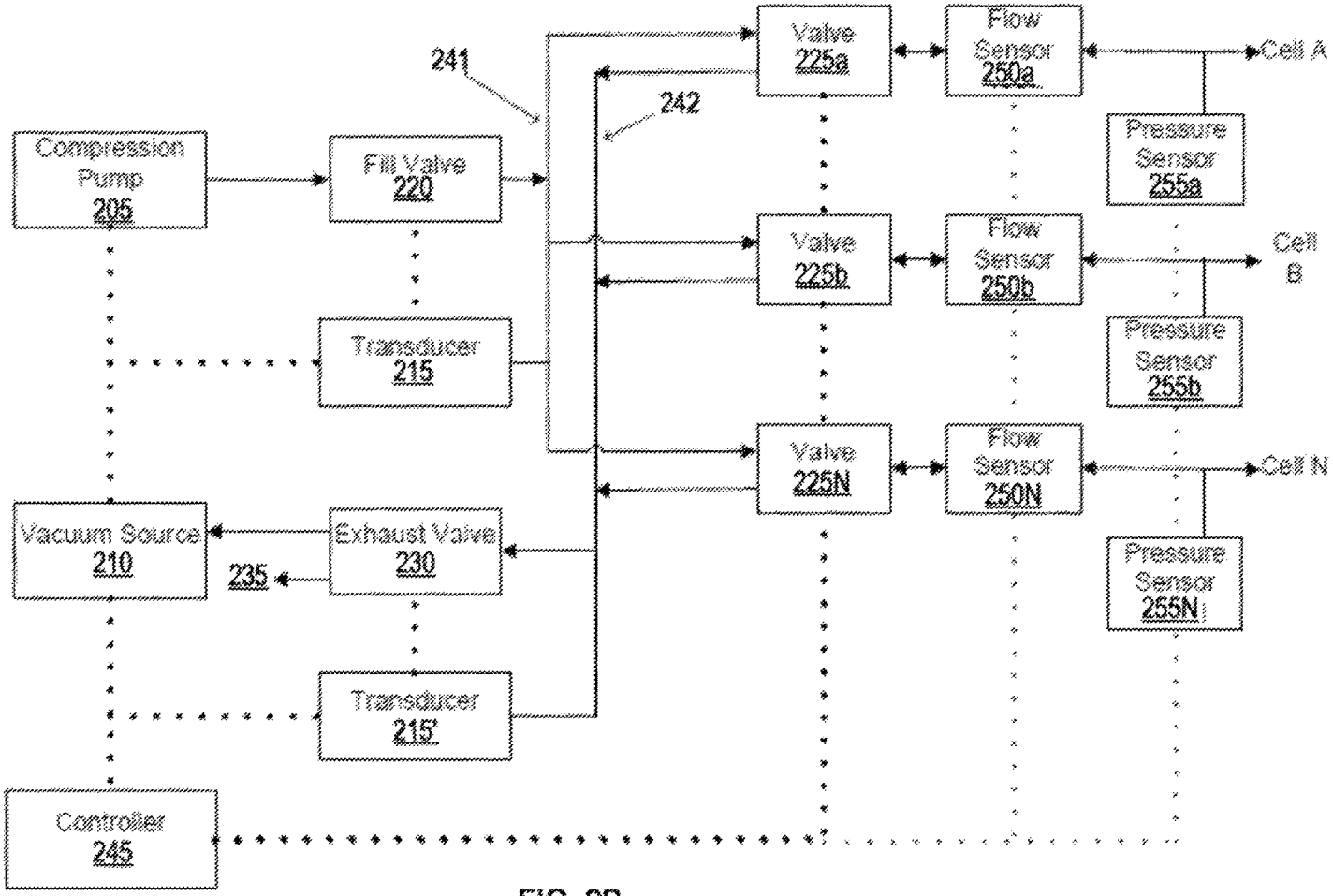

FIGS. 2A and 2B depict an illustrative pneumatic compression therapy device according to some embodiments. As shown in FIG. 2A, the pneumatic compression therapy device may include one or more compression pumps 205, a fill valve 220, a vacuum source 210, an exhaust valve 230, a transducer 215, a controller 245 and a plurality of cell valves, such as 225*a*-N. The compression pump 205 may be used as a source of a pressurized fluid, including, without limitation, air, nitrogen, or water. The fill valve 220 may be in fluid connection with the compression pump 205 through a pressure pump output to receive the pressurized fluid. During an inflation period, the fill valve 220 may open to connect the output of the compression pump 205 to a common node or manifold 240. During a deflation period, exhaust valve 230 may open to connect the common manifold 240 to, for example, a vacuum source 210 to depressurize the cells. Alternatively, exhaust valve 230 may be connected to atmosphere 235. It may be understood that the vacuum source and/or atmosphere may serve as a sink of the pressurizing fluid. One or more inputs to the vacuum or to the atmosphere may be provided. Although FIG. 2A illustrates a single exhaust valve 230 capable of connecting to either a vacuum source 210 or the atmosphere 235, it may be appreciated that one exhaust valve may be used to connect the manifold 240 to the vacuum source 210, while a second exhaust valve may be used to connect the manifold 240 to atmosphere 235. Fill valve 220 and exhaust valve 230 may be manually operated, or may be automatically operated by controller 245. Each of the cell valves 225*a*-N may be connected to the common manifold 240 on a first side and a corresponding cell on a second side. Additionally, one or more sensors, such as pressure sensors or flow rate sensors, may be on the cell side of the valves. Each cell valve 225*a*-N may be used to selectively connect (in an open configuration) or disconnect (in a closed configuration) the corresponding cell to the common manifold 240. Cell valves 225*a*-N may also be manually operated or automatically operated by controller 245.

The transducer 215 may be connected to and used to monitor the pressure of the common manifold 240. The controller 245 may receive information regarding the pressure detected by the transducer 215 or by any other sensor associated with the cell valves (see dotted lines in FIG. 2A). Based on at least the received pressure information, the controller 245 may determine whether to open or close the fill valve 220, the exhaust valve 230, and/or one or more of the cell valves 225*a*-N(see dotted lines in FIG. 2A).

An additional embodiment is illustrated in FIG. 2B. In this embodiment, a fill manifold 241 may be associated with the fill valve 220 and compression pump 205. A separate exhaust manifold 242 may be associated with the vacuum source 210 and exhaust valve 230. Cell valves 225*a*-N may be associated with both the fill manifold 241 and exhaust manifold 242. It is understood that cell valves 225*a*-N in this embodiment may have a 3-way function: open to fill, open to exhaust, and closed. In an alternative embodiment, each cell may have a first valve to connect to the fill manifold 241 and a second valve to connect to the exhaust manifold 242. Exhaust manifold 242 may also be in communication with its own transducer 215' to monitor the pressure within the exhaust manifold. The vacuum source 210, compression pump 205, one or more exhaust valves 230, fill valve 220, and cell valves 225A-N may all be connected to the controller 245 that may control independently their respective operations (see dotted lines in FIG. 2B). Alternatively, any one or more of the vacuum source 210, compression pump 205, one or more exhaust valves 230, fill valve 220 and cell valves 225A-N may be operated manually. Transducers 215 and 215' may provide sensor data as well to controller 245 (see dotted lines in FIG. 2B).

In addition, each valve 225*a*-N may be in fluid connection with a flow sensor 250*a*-N in-line with the connection to its respective cell. Each flow sensor 250*a*-N may be associated with a valve 225*a*-N or with an inflatable cell. Flow sensors 250*a*-N may provide sensor data as well to controller 245 (see dotted lines in FIG. 2B). For example, a flow sensor 250*a*-N may be used to monitor that its respective valve 225*a*-N is completely open. If a valve is blocked or otherwise impeded, the fluid flow through it may not match an expected flow profile as determined by controller 245. Based on the data from the flow sensor, the fill/exhaust rate for a cell may be adjusted by controller 245 to control the amount of time required for a fill or exhaust step.

Additionally, a pressure sensor 255*a*-N may be associated with each cell to measure the fluid pressure within the cell during its operation. Alternatively, each pressure sensor 255*a*-N may be associated with a respective cell valve 225*a*-N. The pressure sensors 2155*a*-N may also provide data to controller 245 so that the controller may be able to control the operation of the compression therapy device (see dotted lines in FIG. 2B). A pressure sensor 255*a*-N associated with its respective cell, may provide direct indication of a pressurization or depressurization profile of the cell to the controller 245 (see dotted lines in FIG. 2B).

Although FIG. 2A does not explicitly illustrate the use of either flow or pressure sensors between the valves 225*a*-N and their respective cells, it may be appreciated that either flow sensors, pressure sensors, or both types of sensors may be included in alternative embodiments. Similarly, although FIG. 2B illustrates the use of such sensors, it should be understood that other embodiments may lack either one or both types of sensors.

Additional features may be associated with the cells, including, without limitation, volume sensors, inflation sensors, and additional valves. FIGS. 3A-3D illustrate a number of embodiments of the inflation cells that may be used with the pneumatic compression therapy device. In one embodiment, illustrated in FIG. 3A, an inflatable cell 310*a* may be in fluid connection with its cell valve 325*a*. Cell valve 325*a* may be in fluid communication with the manifold 240 as in FIG. 2A, or both fill manifold 241 and exhaust manifold 242 as in FIG. 2B.

Figure 3A:
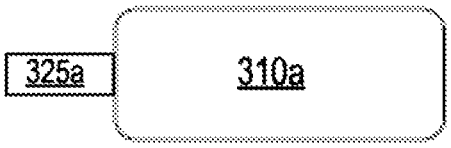
FIGS. 3A-3D depict illustrative pneumatic compression therapy appliance cells according to some embodiments.
Figure 3B:
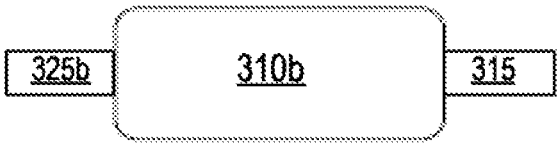

In another embodiment, illustrated in FIG. 3B, cell 310*b* may have a cell valve 325*b* also in fluid communication with the manifold 240 as in FIG. 2A, or manifolds 241 and 242 as in FIG. 2B. In addition, cell 310*b* may have a shunt valve 315 which may be vented to the atmosphere.

Figure 3C:
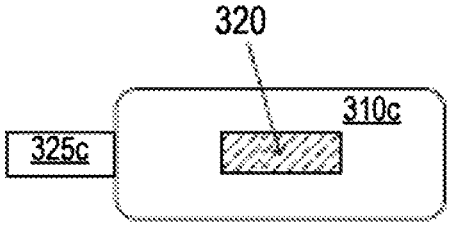

As illustrated in FIG. 3C, a cell 310*c* may have a cell valve 325*c* and may also have a strain gauge (or gauge) 320 associated with the cell material. The strain gauge 320 may be glued or otherwise affixed to the cell 310*c*, or fabricated as part of the cell, and may be associated with either the inner or outer surface of the cell. The strain gauge 320 may be used to measure the deformation of the cell material as it is inflated or deflated, and thereby provide a measure of the volume of fluid within the cell 310*c*.

Figure 3D:
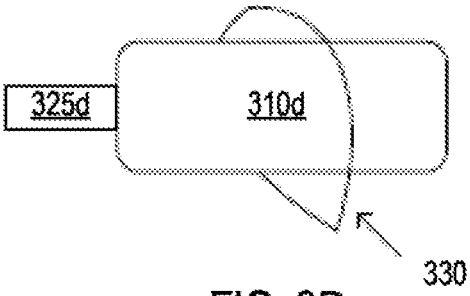

In another embodiment, illustrated in FIG. 3D, cell 310*d* may be in fluid communication with valve 325*d*, permitting the cell to have fluid access to the fill and/or exhaust manifold. Cell 310*d* may be fitted with a plethysmograph sensor 330 that may also be used to detect changes in cell shape or volume during a therapeutic cycle. Multiple plethysmograph sensors may be associated with each cell for improved data collection.

Strain gauge 320 and plethysmograph sensor 330 may be in data communication with controller 245, thereby providing a point of control feedback to the controller. Although a strain gauge 320 and a plethysmograph sensor 330 are illustrated in FIGS. 3C and 3D, it may be understood that additional and/or alternate sensors capable of determining a change in cell shape and/or volume may be used within the scope of this disclosure.

The pneumatic compression therapy device may be operated to provide a variety of compression therapy protocols. A compression therapy protocol may be defined as a specific sequence of operations to inflate (fill) and deflate (exhaust) one or more cells while they are in contact with a patient. A compression therapy protocol may include, for example, a list of an ordered sequence of cells to be activated, an inflation or deflation pressure threshold value for each cell, an amount of time during cell inflation or deflation, and/or a phase or lag time between sequential cell activation. In one non-limiting example, a compression therapy protocol may result in the inflation of a plurality of cells substantially simultaneously. In an alternative non-limiting embodiment, the compression therapy protocol may result in the inflation of a plurality of cells in an ordered sequence. It may be understood that an ordered sequence of cells is a sequence of cell inflation over time. In one non-limiting example, the sequentially inflated cells may be physically contiguous in the compression therapy appliance. In another non-limiting example, the sequentially inflated cells may not be physically contiguous, but may be located in physically separated parts of the compression therapy appliance. In an additional non-limiting example, the compression therapy protocol may result in stopping the inflation of a plurality of cells substantially simultaneously. In an additional non-limiting example, the compression therapy protocol may result in stopping the inflation of a plurality of cells in an ordered sequence. In some non-limiting examples of a compression therapy protocol, each of a plurality of cells may retain fluid at about the same cell pressure. In some non-limiting examples of a compression therapy protocol, each of a plurality of cells may retain fluid at different pressures. A further non-limiting example of the compression therapy protocol may include deflating a plurality of cells substantially simultaneously. A further non-limiting example of the compression therapy protocol may include deflating a plurality of cells in an ordered sequence. It may be understood that an ordered sequence of cells is a sequence of cell deflation over time. In one non-limiting example, the sequentially deflated cells may be physically contiguous in the compression therapy appliance. In another non-limiting example, the sequentially deflated cells may not be physically contiguous, but may be located in physically separated parts of the compression therapy appliance. In yet another non-limiting example of a compression therapy protocol, one of the cells may be inflated and a second cell may be deflated during at least some period of time. As one non-limiting example, one or more cells may be inflated simultaneously as one or more cells are deflated. In another non-limiting example, a first one or more cells may begin inflation and a second one or more cells may begin deflation after the first one or more cells have started inflating. In an alternative non-limiting example, a first one or more cells may begin deflation and a second one or more cells may begin inflation after the first one or more cells have started deflating.

A compression therapy protocol may incorporate one or more cell fill phases. As a non-limiting example of such a fill phase, the following operating sequence may occur. One or more cell valves 225*a*-N may be opened along with the fill valve 220 thereby allowing the one or more cells to be in fluid communication with the compression pump 205. In an embodiment incorporating a common manifold 240, one or more of the cell valves 225*a*-N may open to the common manifold. In an embodiment having independent fill 241 and exhaust 242 manifolds, one or more of the cell valves 225*a*-N may be configured to open the cells to communicate with the fill manifold 241 only. In an embodiment, a cell valve, such as 225*a*, connected to a cell affixed to a distal portion of the patient, may be opened or remain open to the fill 241 or common 240 manifold for inflation while cell valves associated with more proximal cells are closed to that manifold. The cell (e.g. cell A) connected to the open cell valve (for example, 225*a*) may inflate as a result of being connected to the pressurized fluid from the compression pump 205. The cell pressure may be monitored by the controller 245 via the transducer 215, a pressure sensor 255*a* associated specifically with that cell, or by both.

In an embodiment, the amount of pressure sensed by the transducer 215 may differ from the cell pressure at a particular cell. For example, pressure losses may occur between the transducer 215 and a cell. Accordingly, the controller 245 may access a lookup table to determine the threshold at which the pressure sensed by the transducer 215 is appropriate to close the cell valve 225*a*-N corresponding to the cell.

When the cell reaches an appropriate pressure threshold value incorporated as a part of a compression therapy protocol, the controller 245 may close the cell valve 225*a* corresponding to the cell.

A compression therapy protocol may also incorporate one or more cell exhaust phases. As a non-limiting example of such an exhaust phase, the following operating sequence may occur. One or more cell valves 225*a*-N may be opened along with the exhaust valve 230 thereby allowing the one or more cells to be in fluid communication with either the vacuum source 210, or the atmosphere 235. In an embodiment incorporating a common manifold 240, one or more of the cell valves 225*a*-N may open to the common manifold. In an embodiment having independent fill 241 and exhaust 242 manifolds, the one or more cell valves 225*a*-N may be configured to open the cells to communicate with the exhaust manifold 242 only. In an embodiment, a cell valve, such as 225*a*, connected to a cell affixed to a distal portion of the patient, may be opened or remain open to the exhaust 242 or common 240 manifold for deflation while cell valves associated with more proximal cells are closed to that manifold. The cell (e.g. cell A) connected to the open cell valve (for example, 225*a*) may deflate as a result of being connected to the vacuum source 210 or atmosphere 235. The cell pressure may be monitored by the controller 245 via transducer 215 for a common manifold configurations or transducer 215' for independent manifold configurations, a pressure sensor 255*a* associated specifically with that cell, or by both.

In an embodiment, the amount of pressure sensed by the transducer 215 or transducer 215' may differ from the cell pressure at a particular cell. For example, pressure losses may occur between the transducer 215 (or 215') and a cell. Accordingly, the controller 245 may access a lookup table to determine the threshold at which the pressure sensed by the transducer 215 (or 215') is appropriate to close the cell valve 225*a*-N corresponding to the cell.

It may be appreciated that a compression therapy protocol may be composed of any variety of sequences of cell inflation and deflation steps. Cells may be inflated and deflated in a specific order, and multiple cells may be inflated or deflated either in synchrony or in a staggered fashion. The cells may be held at a particular inflation or deflation pressure for a specific amount of time. In addition, a specific compression therapy protocol may be repeated with some lag time between repeats. Alternatively, a first compression therapy protocol may be followed by a second and different compression therapy protocol.

In one embodiment of a compression therapy protocol, a plurality of cell valves 225*a*-N may be opened simultaneously to inflate the plurality of respective cells simultaneously. As the pressure in each cell surpasses a corresponding threshold, the controller 245 may close the cell valve 225*a*-N for the cell. The pressure thresholds for all the cells may be identical or they may differ. For example, the pressure threshold for a cell at a distal position on a patient may be higher than a cell more proximally located. As a result, a pressure gradient may be developed by the cells from a greater pressure at the distal point, to a lesser pressure at the proximal point. The cells may then be deflated simultaneously until they all reach an ambient pressure. Alternatively, only selected cells may be deflated.

In another embodiment of a compression therapy protocol, the cell valves 225*a*-N may not be opened simultaneously when the cells are deflated, but rather may be opened in a staggered fashion. In an embodiment based on the common manifold configuration, fill valve 220 may be closed, and exhaust valve 230 may be opened to either the vacuum source 210 or to atmosphere 235. A first cell valve, such as 225*a*, may be opened to release the pressure in the corresponding cell. After a short period of time elapses, a second cell valve, such as 225*b*, may be opened to release the pressure in the corresponding cell. Such a time delay between the deflation of successive cells, may be about 1 second long or longer. In an alternative non-limiting example, the controller 245 may cause a cell valve, such as 225*a* or 225*b*, to release the pressure in the corresponding cell in response to the controller receiving data from a corresponding cell sensor, such as a pressure sensor 255*a* or 255*b*. The controller 245 may cause the pressure in a cell to be released when the sensor data has achieved a compression therapy protocol defined threshold value, such as a maximum pressure. The process may be repeated until each cell valve 225*a*-N has been opened.

Figure 4:
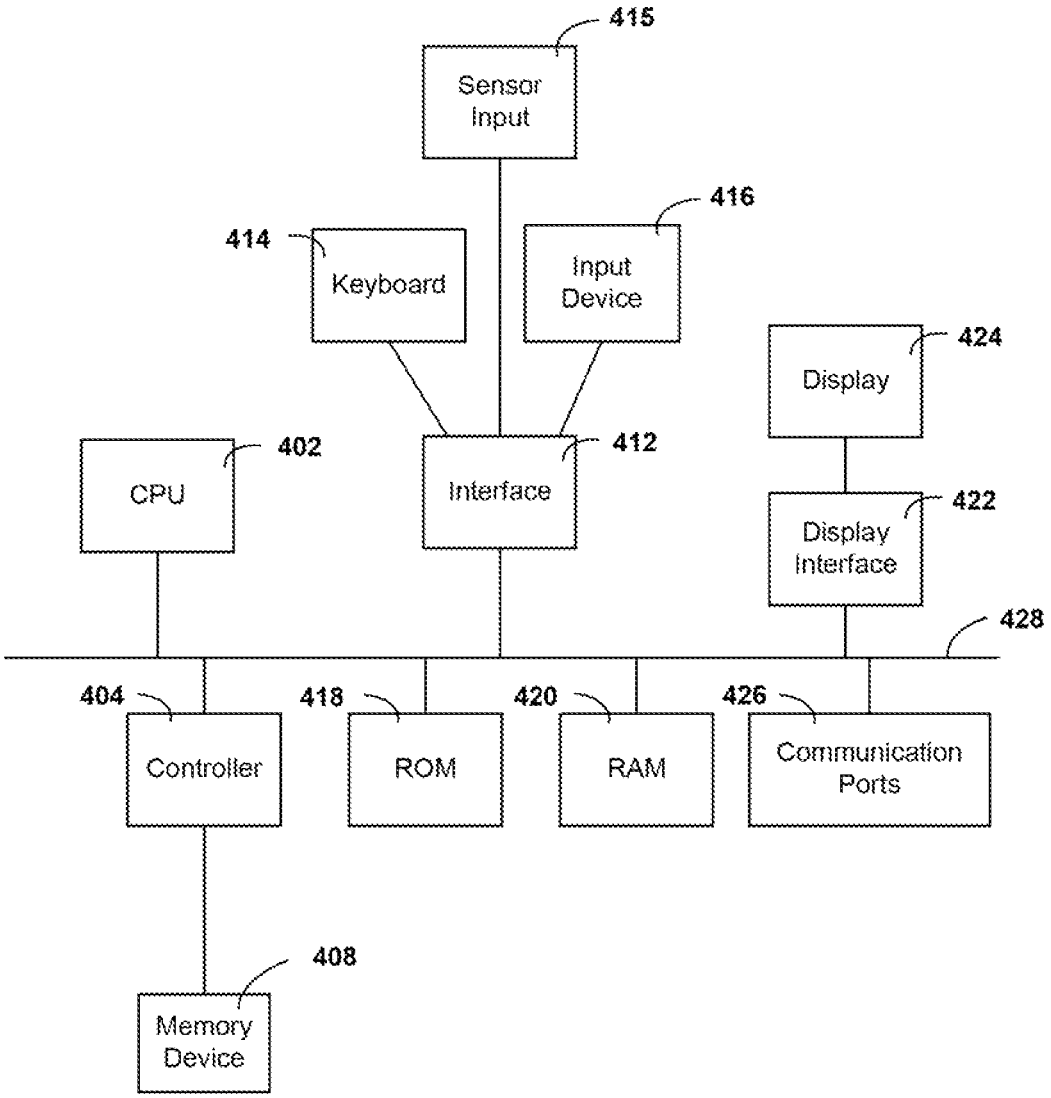
FIG. 4 depicts a block diagram of illustrative hardware that may be used to contain or implement program instructions according to some embodiments.

FIG. 4 depicts a block diagram of an embodiment of hardware that may be used to contain or implement program instructions for controller 245. Some or all of the below-described hardware may be incorporated in the controller 245. Referring to FIG. 4, a bus 428 may serve as the main information highway interconnecting the other illustrated components of the hardware. CPU 402 or other computing device is the central processing unit of the system, performing calculations and logic operations required to execute a program. Read only memory (ROM) 418 is one embodiment of a static memory device and random access memory (RAM) 420 is one embodiment of a dynamic memory device.

A controller 404 may interface the system bus 428 with one or more memory devices 408. The memory devices 408 may include, without limitation, external or internal DVD drives, CD ROM drives, or hard drives. Such drives may also be used as non-transitory computer-readable storage media.

Program instructions may be stored in the ROM 418 and/or the RAM 420. Optionally, program instructions may be stored on a non-transitory computer readable storage medium, such as a compact disk or a digital disk or other recording medium. Such program instructions may include a library of pre-loaded compression therapy protocols. Non-limiting examples of such program instructions may cause the controller to receive an input related to one or more compression therapy protocols from an input device, place at least one of the plurality of valves into one of the first state, second state, or third state for a period of time based at least in part on the one or more compression therapy protocols, receive cell sensor data from at least one cell sensor, and transmit, to the output device, an output related to the data from at least one cell sensor. Various instructions may be directed towards receiving sensor data, for example from pressure or flow sensors associated with the valves, and comparing them against appropriate threshold values as included in the compression therapy protocol. Similar instructions may be directed towards placing any of the valves into any of the possible cell states based on the sensor data values and threshold values according to the compression therapy protocol.

An optional display interface 422 may permit information from the bus 428 to be displayed on the display 424 in audio, graphic or alphanumeric format. Communication with external devices may occur using various communication ports 426. For example, communication with the fill valve 220, exhaust valve 230, and/or the cell valves 225*a*-N(see FIGS. 2A and 2B) may occur via one or more communication ports 426. Controller 245 may also provide command data over communication ports 426 to valves 220, 230, and 225*a*-N (see FIGS. 2A and 2B) to direct their respective operations.

In addition to the components disclosed above, the hardware may also include an interface 412 which allows for receipt of data from input devices such as a keyboard 414 or other input device 416 such as a mouse, remote control, pointing device and/or joystick. Such input devices may allow a user to choose a pre-programmed compression therapy protocol from a library of such protocols maintained by the controller, enter parameters into a preprogrammed protocol, or enter a new compression therapy protocol into the controller. In addition, transducers 215 and 215', pressure sensors 255*a*-N, flow sensors 250*a*-N(see FIGS. 2A and 2B), as well as sensors communicating data related to the change in shape or volume of the cells, such as a strain gauge 320 and/or a plethysmograph 330 (see FIGS. 3A-3D), may communicate sensor input 415 through interface 412 to bus 428.

In an embodiment, the controller 245 may store and/or determine settings specific to each cell. For example, the controller 245 may determine one or more pressure thresholds for each cell. Moreover, the controller 245 may prevent the pneumatic compression therapy device from being used improperly by enforcing requirements upon the system. For example, the controller 245 may be programmed according to a compression therapy protocol so that distal cells are required to have higher pressure thresholds than proximal cells. The controller may override instructions received from a user (for example, via the user interface) that do not conform to such pressure threshold requirements. In an embodiment, the pressure thresholds of one or more cells may be adjusted to meet the pressure threshold constraints.

In a further embodiment, controller 245 may provide a user of a compression therapy device with an interface to permit the user to program the control to provide a variety of compression therapy protocols for patients. The interface may be displayed on the control display 424, such as a flat panel display. Input devices 416 such as a mouse, keypad, or stylus may be used by the user to provide data to define a particular compression therapy protocol. The controller 245 may record the compression therapy protocol on a memory or disk device 408 for future use. In one embodiment of the controller 245, a user may be presented with a list of previously stored compression therapy protocols from which to choose for a particular patient. In another embodiment, a user may define a compression therapy protocol for a patient on an as-needed basis. In another embodiment, a user may choose a stored compression therapy protocol and modify it. It may be appreciated that such programming may be accomplished through any of a variety of methods. In one non-limiting example, a therapist or other health care professional may enter commands and/or parameters via a keyboard 414. In another non-limiting example, the therapist or other health care professional may use a mouse or touch screen to select one or more pre-programmed compression therapy protocols or parameters from a menu. In yet another non-limiting example, the therapist or other health care professional may program a compression therapy protocol via a graphical interface presenting compression therapy protocol "primitives." The user may define a compression therapy protocol by selecting a group of graphical primitives representing cells, valves, sensors, and the like, and link them together to form a complete protocol. As one non-limiting example, a final graphical presentation of a compression therapy protocol may be presented on an output device such as a graphical display 424 as a flow-chart listing steps, cell inflation order, time between cell inflations/deflations, cell pressure hold parameters, and/or fluid flow rate or pressure thresholds.

In addition to storing compression therapy protocols, the controller 245 may also record sensor readings obtained through a sensor input 415 during a particular therapy session. Sensor readings may include, without limitation, cell pressures, cell volumes, cell inflation data, and/or air or vacuum air flow values. The controller 245 may also record patient related data such as blood pressure or blood oxygen saturation levels measured during a therapeutic session, as well as a date and time for the session. The controller 245 may also record therapy notes entered by the user.

Although not illustrated in FIG. 4, controller 245 may also include a number of communications interfaces to either a network or a wireless device such as a smart phone, a personal digital assistant (PDA), a tablet computing device, a laptop computing device, a server computing device, a local area network device, and a wide area network device. Such communication interfaces may permit the controller 245 to be monitored remotely by a clinician to obtain performance data or patient compliance data. Such communication interfaces may also permit a remote clinician to program the controller 245. As one non-limiting example, a physician or technologist may program a new compression therapy protocol in the controller 245. Alternatively, the care provider may transmit parameter data for a pre-programmed compression therapy protocol, or select a pre-programmed compression therapy protocol in the controller 245. In one embodiment, a cell phone may have an application that may bring up a user-friendly programming interface to permit ease of reprogramming. Alternatively, a remote computer may display a web-enabled display for programming, data assessment, and/or analysis.

Figure 5A:
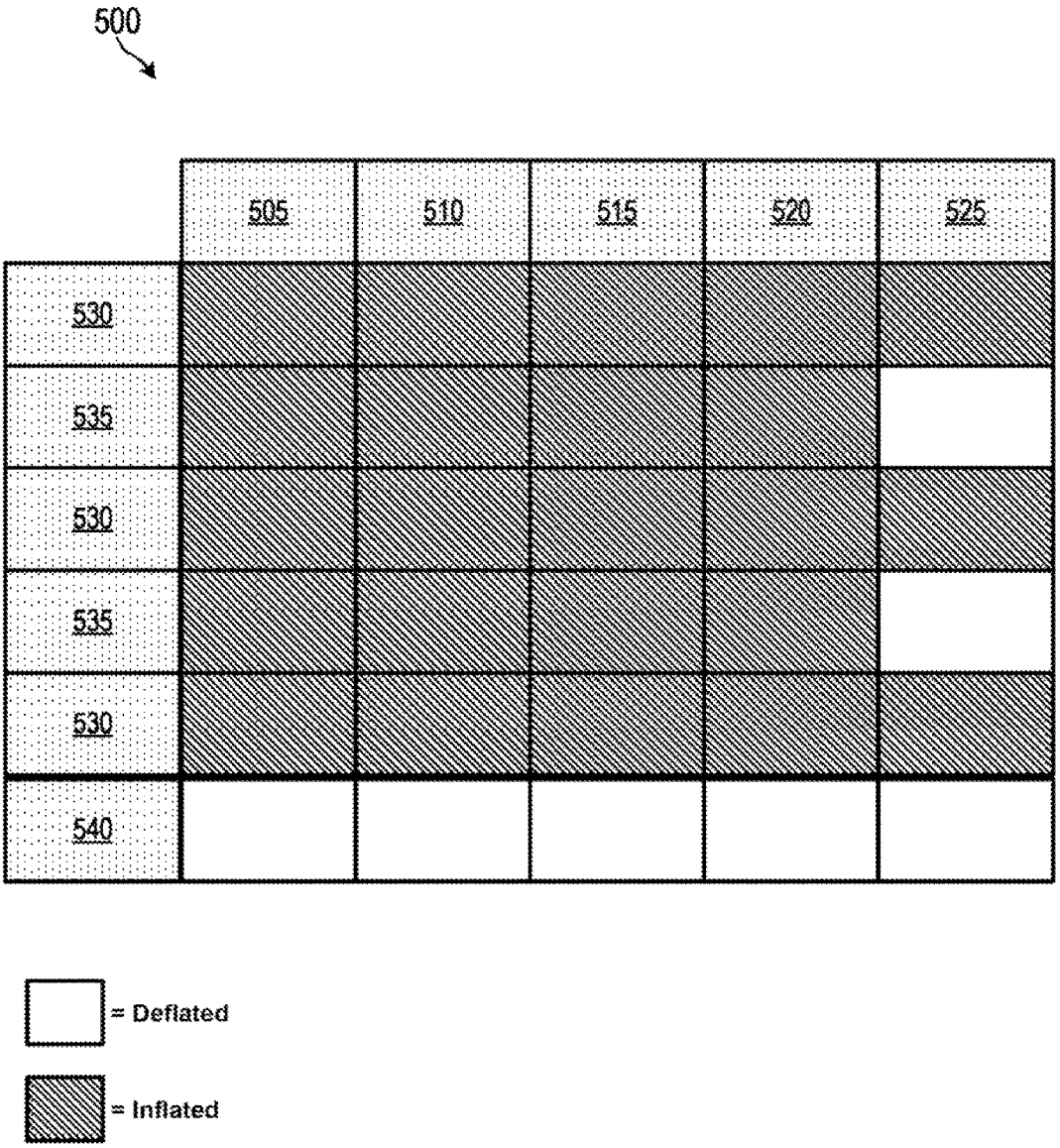
FIGS. 5A-5G depict illustrative compression therapy protocols according to some embodiments.
Figure 5B:
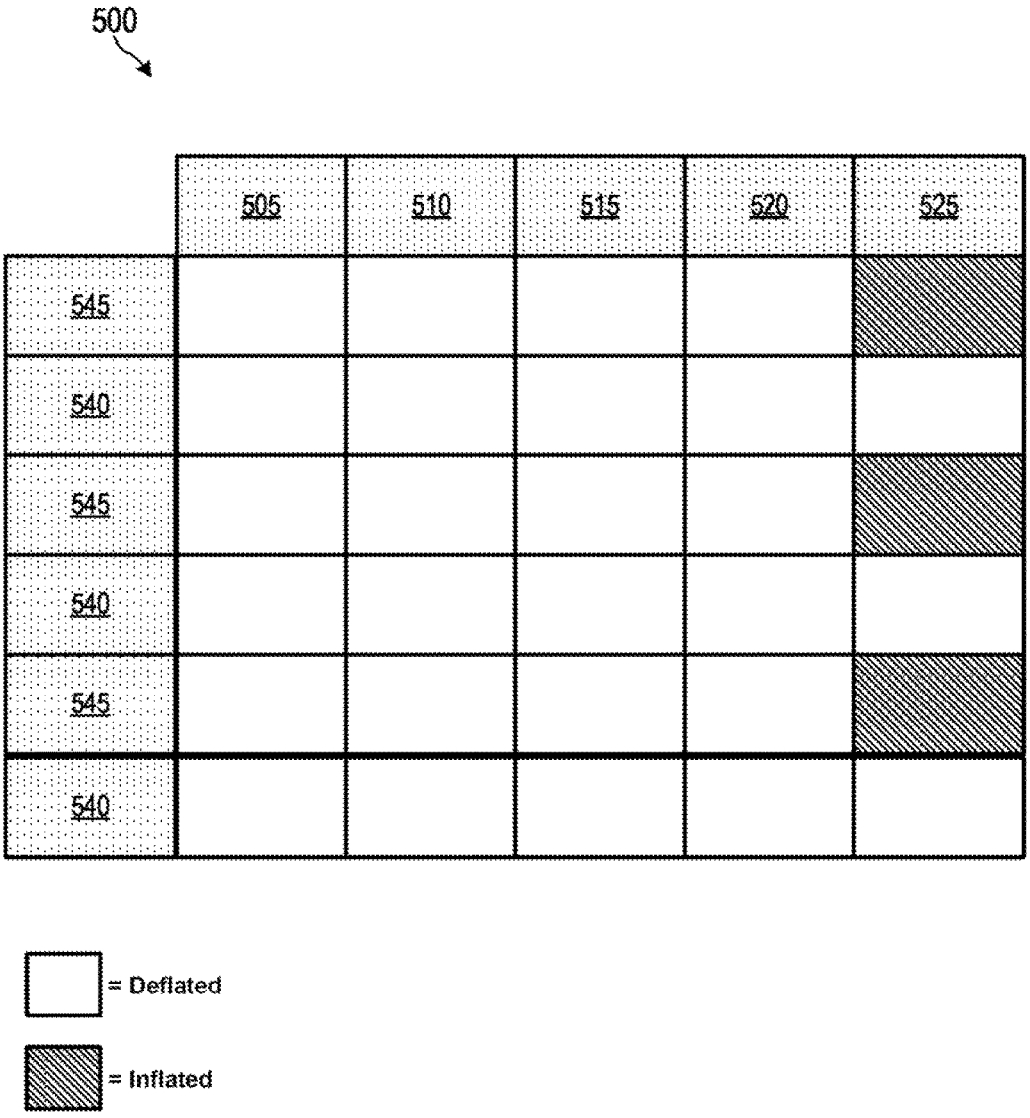
Figure 5C:
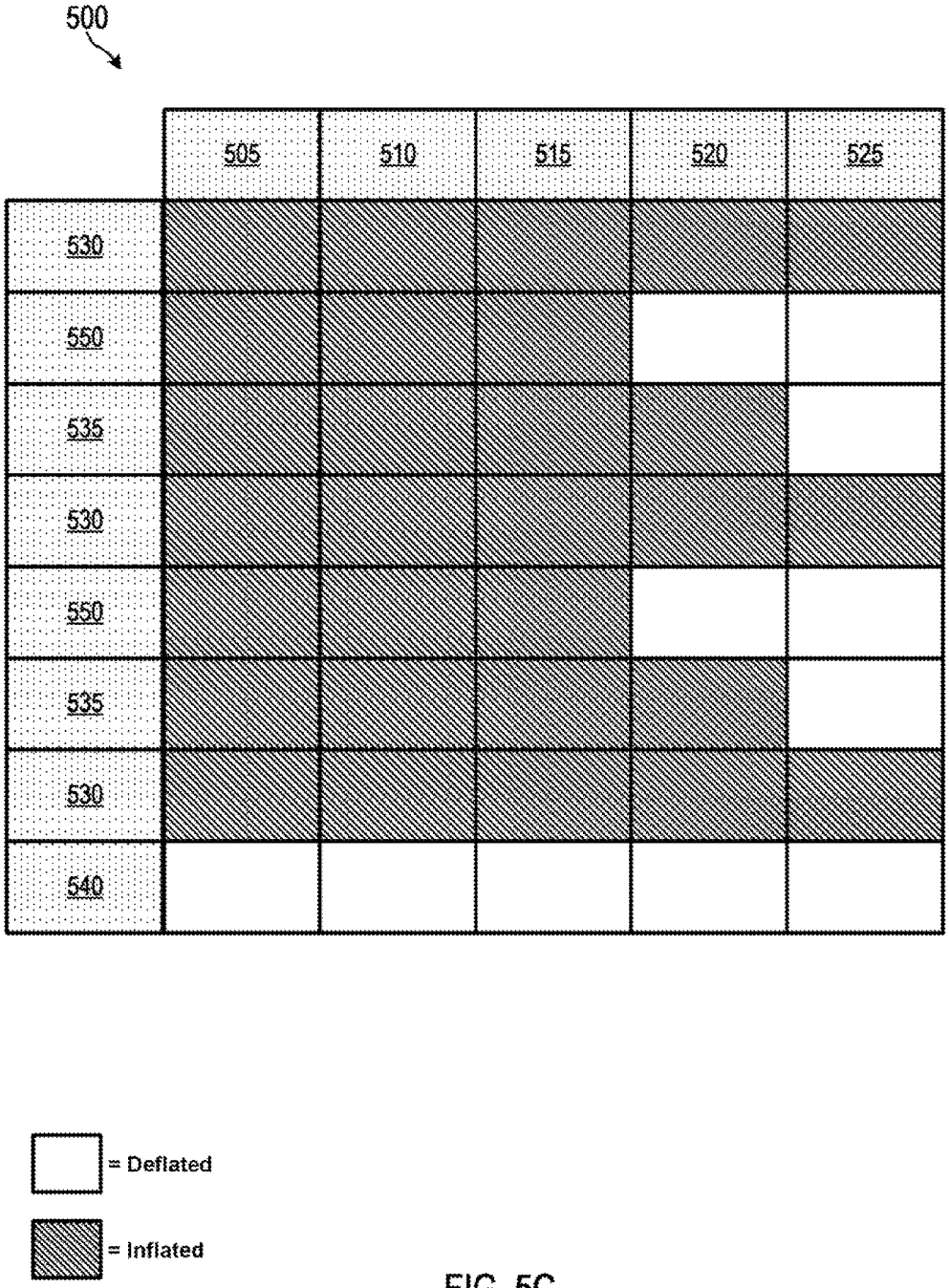
Figure 5D:
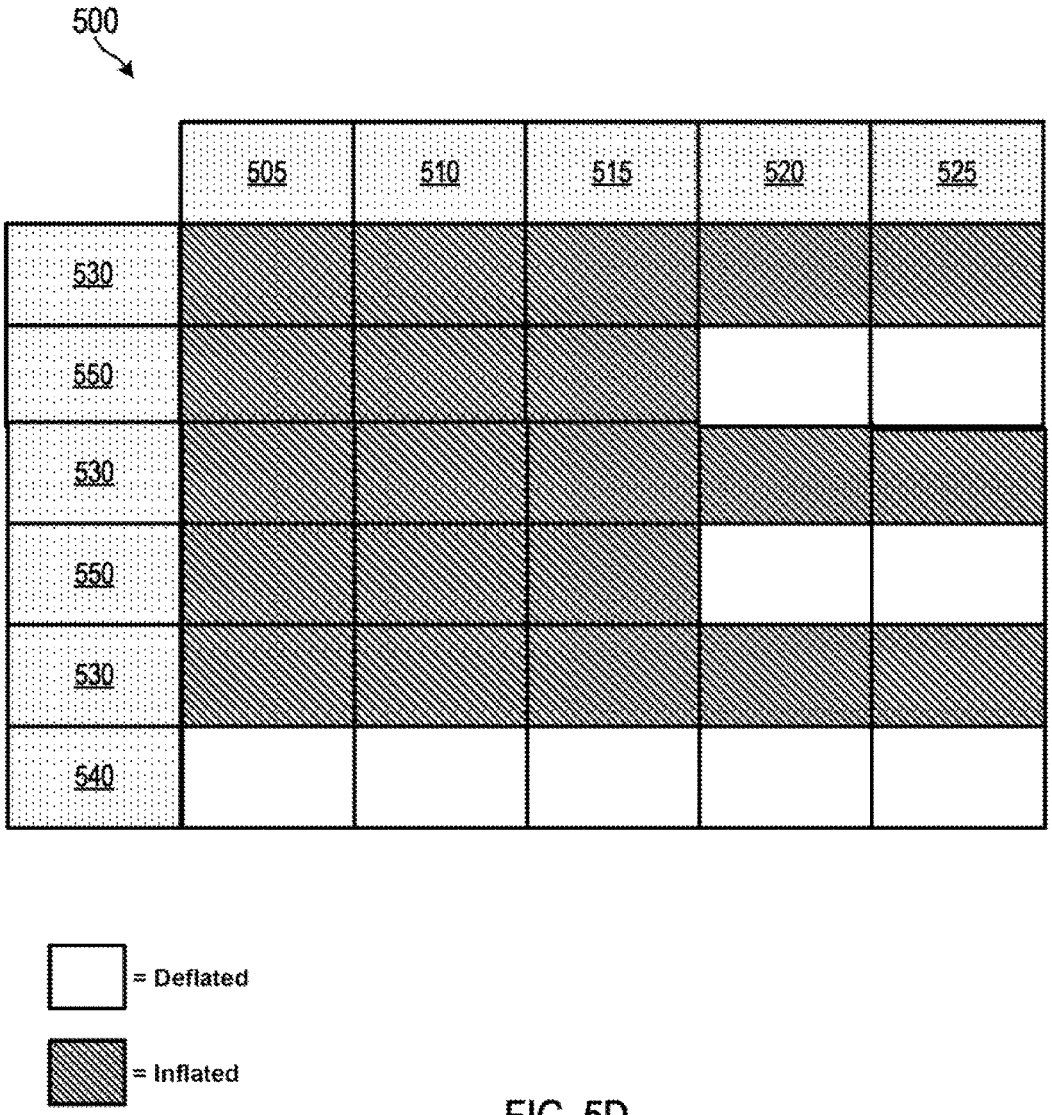
Figure 5E:
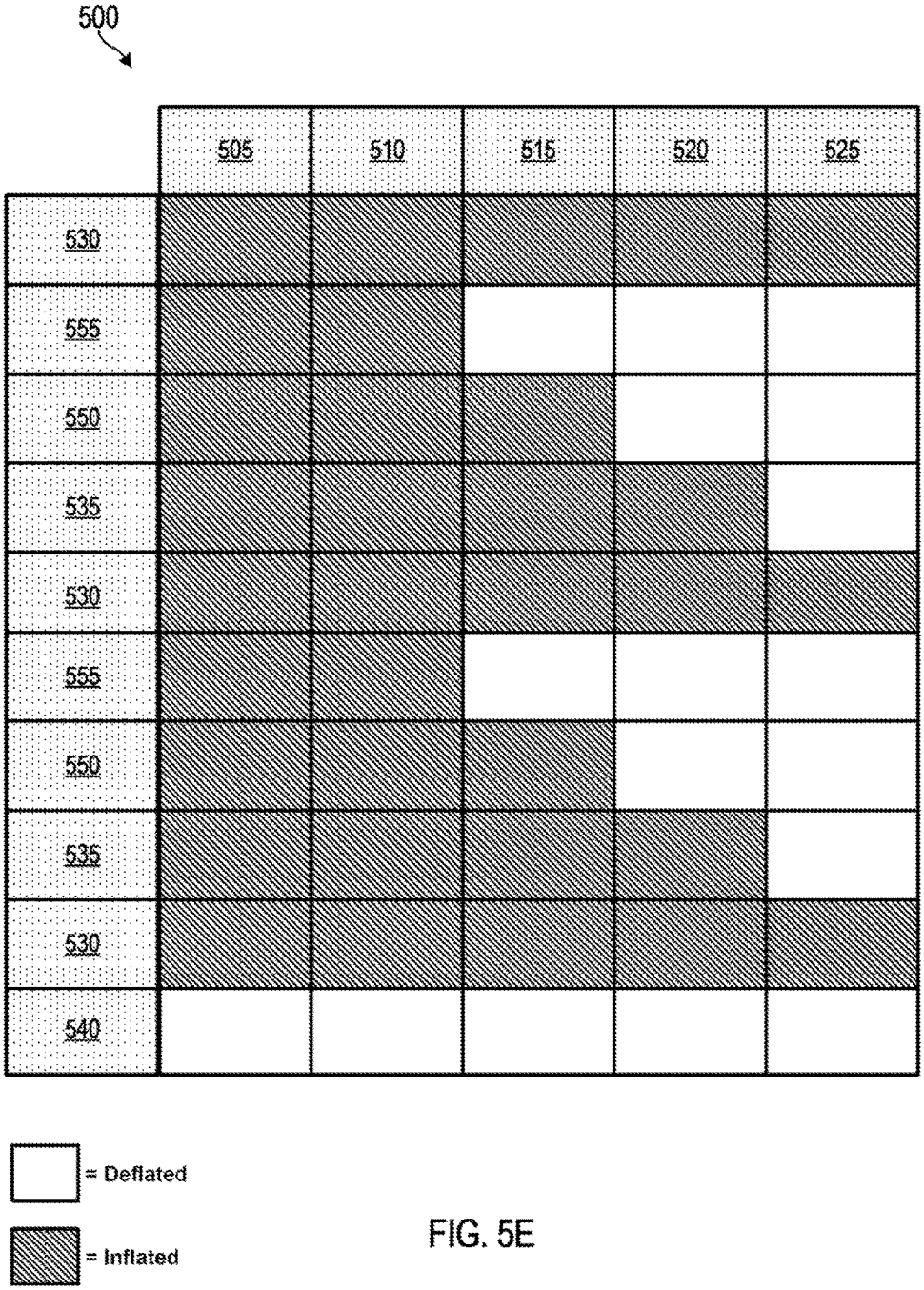
Figure 5F:
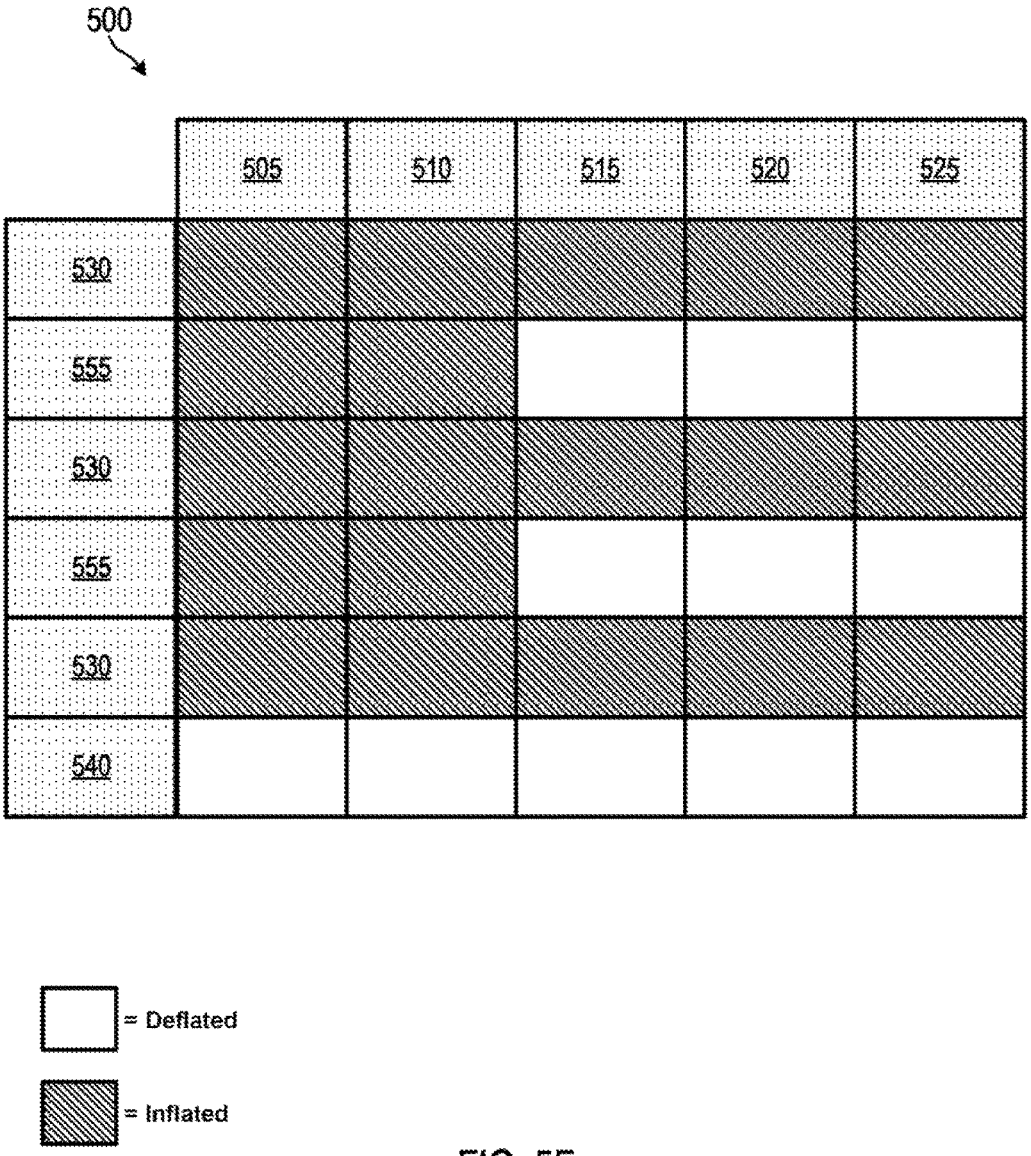
Figure 5G:
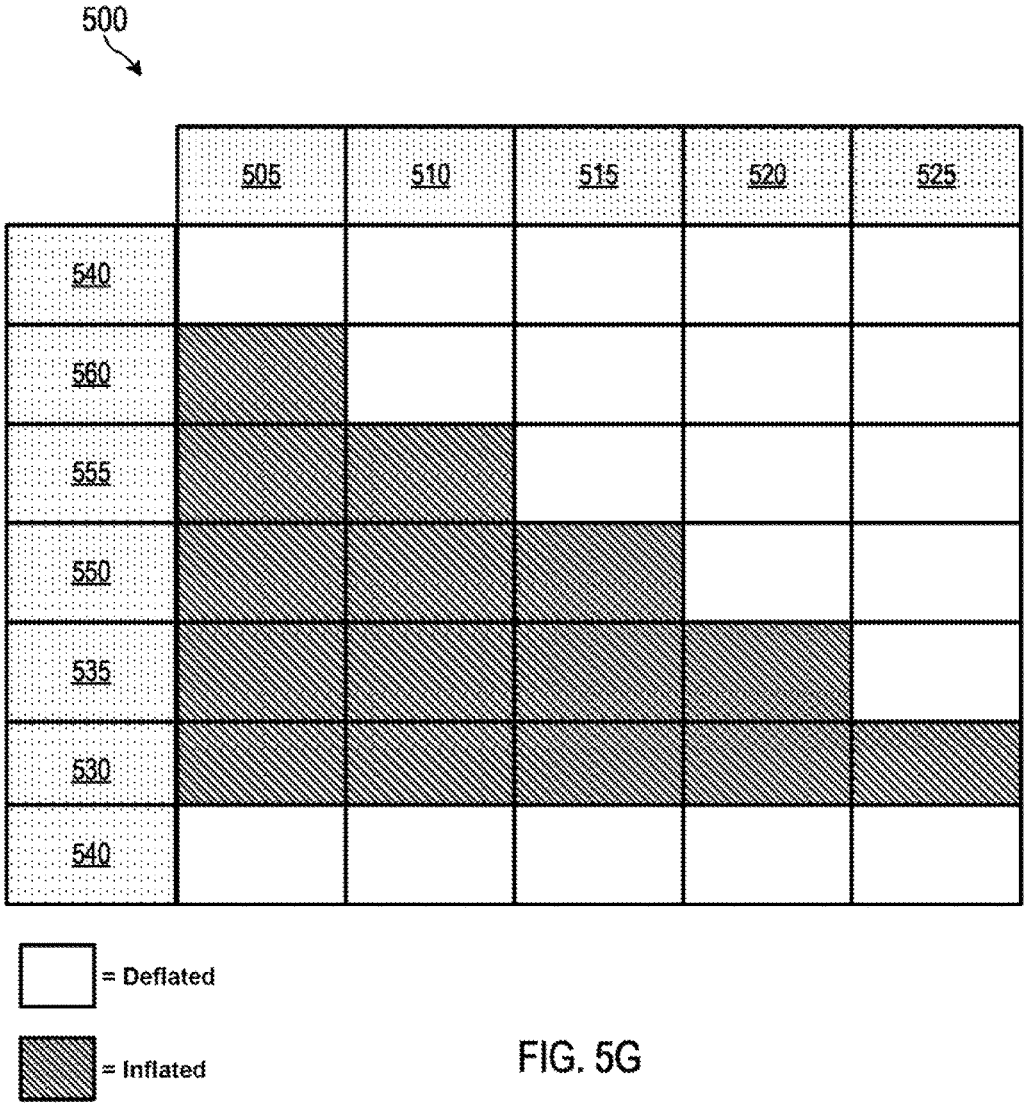

FIGS. 5A-5G depict illustrative compression therapy protocols according to some embodiments. One or more of the compression therapy protocols depicted in FIGS. 5A-5G may be used in any sequence and/or combination. In addition, one or more of the compression therapy protocols depicted in FIGS. 5A-5G may be used in sequence and/or combination with any other compression therapy protocol known to those having ordinary skill in the art. In some embodiments, one or more of the compression therapy protocols depicted in FIGS. 5A-5F may be used as a proximal decongestive phase of treatment that is administered before conventional distal-to-proximal compression phases of treatment (as depicted in FIG. 5G). The proximal decongestive phase of treatment may be configured to clear the proximal area (for example, the torso region or the shoulder) before sequential pressure is applied along the limb (for example, an arm) distally (for example, the wrist) to proximally (for example, the shoulder) to force fluid within the extremity toward the proximal area. Fluid decongesting of the proximal area may be configured to, among other things, prevent any "damming effect" in the proximal area when sequential pressure is applied distally to proximally along the extremity. In some embodiments, one or more of the compression therapy protocols depicted in FIGS. 5A-5G may be used to prevent a reverse gradient in the treated extremity to prevent reverse flow (for instance, forcing fluid to flow proximally from the torso region to distally toward the hand or foot).

FIG. 5A depicts an illustrative compression therapy protocol or pattern for a compression therapy appliance (such as the compression therapy appliance depicted in FIG. 1) having 5 cells 505-525. In some embodiments, cell 505 may be the distal cell (for example, closest to the foot or arm), cell 525 may be the proximal cell (for example, closest to the torso), and cells 510-520 may be medial cells. One having ordinary skill in the art would understood that the description that follows, although specifically referencing a 5-cell appliance as depicted in FIG. 1, may similarly apply to compression therapy appliances having more or fewer cells and to compression therapy appliances used on body portions other than the extremities The compression therapy protocol 500 may include alternating step 530 and 535. Step 530 may be a step resulting in all cells 505-525 being inflated. Step 535 may be a step resulting in cells 505-520 remaining inflated and proximal cell 525 being deflated. If step 535 occurs after step 530, only cell 525 may be deflated while the remaining cells 505-520 may remain inflated. If step 530 occurs after step 535, then only cell 525 may be inflated, since the remaining cells 505-520 had been held at a final pressure from a previous step 530.

Each step 530, 535 may be active for a particular duration specified by the compression therapy protocol 500. In some embodiments, each step 530, 535 may last for the same duration. In some embodiments, one or more steps 530, 535 may last for different durations. In one embodiment, step 535 may occur immediately after step 530. In one embodiment, step 530 may occur immediately after step 535. In yet another embodiment, step 530 may be held for some period of time before step 535 occurs. In yet another embodiment, step 535 may be held for some period of time before step 530 occurs. The time between steps may be programmed into the controller 245 as part of a compression therapy protocol or may be chosen by a health care worker at the time that therapy occurs. In some non-limiting examples, a hold time between steps may be about 0 seconds to about 20 seconds. Non-limiting examples of a hold time between steps may be about 0 seconds, 5 seconds, 10 seconds, 15 seconds, 20 seconds, or any value between any two of these values (including endpoints). With respect to FIG. 5A, a cycle may be defined as a sequence of step 535 followed by step 530. Such a cycle may be repeated once, twice, 3 times, 5 times, 8 times, 10 times, 12 times, or any number of times in a range between any two of these values (including endpoints). A cycle rest time may be defined as a time between cycles. In some non-limiting examples, a cycle rest time may last for about 2 seconds to about 20 seconds. Non-limiting examples of a cycle rest time may be about 0 seconds, 5 seconds, 10 seconds, 15 seconds, 20 seconds, or any value between any two of these values (including endpoints). In some embodiments, all of the cells 505-525 may be deflated 540 for a duration after the completion of the compression therapy protocol.

In step 530, the independently inflatable cells 505-525 may all be inflated to attain about the same pressure. Alternatively, each of the independently inflatable cells 505-525 may be inflated to an independently chosen pressure. In one non-limiting embodiment, the independently inflatable cells 505-525 may be inflated to provide a pressure gradient along the body part (for example, from a distal portion such as an ankle to a proximal portion such as the abdomen). In one non-limiting example, distal cell 505 may be inflated to a pressure of about 50 mmHg (6.67 kPa), cell 510 may be inflated to a pressure of about 45 mmHg (6.0 kPa), cell 515 may be inflated to a pressure of about 40 mmHg (5.33 kPa), cell 520 may be inflated to a pressure of about 35 mmHg (4.67 kPa), and proximal cell 525 may be inflated to a pressure of about 30 mmHg (4.0 kPa).

FIG. 5B depicts a compression therapy protocol 500 that includes alternating steps 545 and 540. Step 545 may be a step resulting in only proximal cell 525 being inflated, while cells 505-520 remain in a deflated state. Step 540 may be a step resulting in all cells 505-525 being deflated.

Each step 540, 545 may be active for a particular duration specified by the compression therapy protocol 500. In some embodiments, each step 540, 545 may last for the same duration. In some embodiments, one or more steps 540, 545 may last for different durations. In one embodiment, step 545 may occur immediately after step 540. In one embodiment, step 540 may occur immediately after step 545. In yet another embodiment, step 540 may be held for some period of time before step 545 occurs. In yet another embodiment, step 545 may be held for some period of time before step 540 occurs. The time between steps may be programmed into the controller 245 or may be chosen by a health care worker at the time therapy occurs. In some non-limiting examples, a hold time between steps may be about 0 seconds to about 20 seconds. Non-limiting examples of a hold time between steps may be about 0 seconds, 5 seconds, 10 seconds, 15 seconds, 20 seconds, or any value between any two of these values (including endpoints). The steps 540, 545 may be active for any duration capable of operating according to some embodiments described herein. With respect to FIG. 5B, a cycle may be defined as a sequence of step 540 followed by step 545. Such a cycle may be repeated once, twice, 3 times, 5 times, 8 times, 10 times, 12 times, or any number of times in a range between any two of these values (including endpoints). A cycle rest time may be defined as a time between cycles. In some non-limiting examples, a cycle rest time may last for about 2 seconds to about 20 seconds. Non-limiting examples of a cycle rest time may be about 0 seconds, 5 seconds, 10 seconds, 15 seconds, 20 seconds, or any value between any two of these values (including endpoints). In some embodiments, all of the cells 505-525 may be deflated 540 for a duration after the completion of the compression therapy protocol.

FIG. 5C depicts a compression therapy protocol 500 that includes steps 530, 550, and 535. Although FIGS. 5A and 5B depict alternate inflating and deflating of the proximal cell 525, FIG. 5C depicts a protocol in which the proximal cell 525 and a cell distal to the proximal cell (here, cell 520) alternate between an inflated and deflated state. It may be understood that in this non-limiting example, a cell distal to the proximal cell 520 may be the cell immediately distal to the proximal cell 525. However, one having ordinary skill in the art may recognize that a cell distal to the proximal cell may include any cell distal to the proximal cell 525, and not only the immediately distal cell. In step 530, all of the cells 505-525 may be inflated. Cells 505-515 may remain at a final pressure in step 550 while the proximal cell 525 and more distal cell 520 may be deflated. In step 535, the cell 520 distal to the proximal cell 525 may be inflated while the proximal cell 525 remains in a deflated state and cells 505-515 remain inflated. All cells 505-525 may be deflated in step 540.

Each step 530, 550, and 535 may be active for a particular duration specified by the compression therapy protocol 500. In some embodiments, each step 530, 550, and 535 may last for the same duration. In some embodiments, one or more steps 530, 550, and 535 may last for different durations. In one embodiment, step 550 may occur immediately after step 530. In one embodiment, step 535 may occur immediately after step 550. In one embodiment, step 530 may occur immediately after step 535. Any one or more of steps 530, 550, and 535 may be held for some period of time before a succeeding step occurs. The time between steps may be programmed into the controller 245 or may be chosen by a health care worker at the time therapy occurs. In some non-limiting examples, a hold time between steps may be about 0 seconds to about 20 seconds. Non-limiting examples of a hold time between steps may be about 0 seconds, 5 seconds, 10 seconds, 15 seconds, 20 seconds, or any value between any two of these values (including endpoints). The steps 530, 550, and 535 may be active for any duration capable of operating according to some embodiments described herein. With respect to FIG. 5C, a cycle may be defined as a sequence of step 530 followed by step 550 and then step 535. Such a cycle may be repeated once, twice, 3 times, 5 times, 8 times, 10 times, 12 times, or any number of times in a range between any two of these values (including endpoints). A cycle rest time may be defined as a time between cycles. In some non-limiting examples, a cycle rest time may last for about 2 seconds to about 20 seconds. Non-limiting examples of a cycle rest time may be about 0 seconds, 5 seconds, 10 seconds, 15 seconds, 20 seconds, or any value between any two of these values (including endpoints). In some embodiments, all of the cells 505-525 may be deflated 540 for a duration after the completion of the compression therapy protocol.

In step 530, the independently inflatable cells 505-525 may all be inflated to attain about the same pressure. Alternatively, each of the independently inflatable cells 505-525 may be inflated to an independently chosen pressure. In one non-limiting embodiment, the independently inflatable cells 505-525 may be inflated to provide a pressure gradient along the body part (for example, from a distal portion such as an ankle to a proximal portion such as the abdomen). In one non-limiting example, distal cell 505 may be inflated to a pressure of about 50 mmHg (6.67 kPa), cell 510 may be inflated to a pressure of about 45 mmHg (6.0 kPa), cell 515 may be inflated to a pressure of about 40 mmHg (5.33 kPa), cell 520 may be inflated to a pressure of about 35 mmHg (4.67 kPa), and proximal cell 525 may be inflated to a pressure of about 30 mmHg (4.0 kPa).

FIG. 5D depicts a compression therapy protocol 500 that includes two steps 530, 550. In step 530, all of the cells 505-525 may be inflated. In step 550, the proximal cell 525 and at least one cell distal to the proximal cell may be deflated while the remaining cells are maintained at their inflation pressures. As disclosed above, with respect to FIG. 5C, the at least one cell distal to the proximal cell may include any cell distal to the proximal cell, and is not limited to one or more cells immediately distal to the proximal cell 525. As one non-limiting example, depicted in FIG. 5D, proximal cell 525 and medial cell 520 (being distal to the proximal cell) may be deflated, while cells 505-515 remain in an inflated state.

Each step 530, 550 may be active for a particular duration specified by the compression therapy protocol 500. In some embodiments, each step 530, 550 may last for the same duration. In some embodiments, one or more steps 530, 550 may last for different durations. In one embodiment, step 550 may occur immediately after step 530. In one embodiment, step 530 may occur immediately after step 550. In yet another embodiment, step 530 may be held for some period of time before step 550 occurs. In yet another embodiment, step 550 may be held for some period of time before step 540 occurs. The time between steps may be programmed into the controller 245 or may be chosen by a health care worker at the time therapy occurs. In some non-limiting examples, a hold time between steps may be about 0 seconds to about 20 seconds. Non-limiting examples of a hold time between steps may be about 0 seconds, 5 seconds, 10 seconds, 15 seconds, 20 seconds, or any value between any two of these values (including endpoints). The steps 530, 550 may be active for any duration capable of operating according to some embodiments described herein. With respect to FIG. 5D, a cycle may be defined as a sequence of step 530 followed by step 550. Such a cycle may be repeated once, twice, 3 times, 5 times, 8 times, 10 times, 12 times, or any number of times in a range between any two of these values (including endpoints). A cycle rest time may be defined as a time between cycles. In some non-limiting examples, a cycle rest time may last for about 2 seconds to about 20 seconds. Non-limiting examples of a cycle rest time may be about 0 seconds, 5 seconds, 10 seconds, 15 seconds, 20 seconds, or any value between any two of these values (including endpoints). In some embodiments, each step 530, 550 may be followed by a hold time before the compression therapy device activates the next step. In some embodiments, all of the cells 505-525 may be deflated 540 for a duration after the completion of the compression therapy protocol.

FIG. 5E depicts a compression therapy protocol 500 that includes steps 530, 555, 550, and 535. Although FIG. 5C depicts alternate inflating and deflating of the proximal cell 525 and one cell distal to the proximal cell, FIG. 5E depicts a protocol in which the proximal cell 525 and two cells distal to the proximal cell (here, cells 515 and 520) alternate between an inflated and deflated state. As disclosed above, with respect to FIG. 5D, the two cells distal to the proximal cell 525 may include any cells distal to the proximal cell, and are not limited to one or more cells immediately distal to the proximal cell 525. In step 530, all of the cells 505-525 may be inflated. Cells 505-510 may remain at a final pressure in step 555 while the proximal cell 525 and more distal cell 520 and 515 may be deflated. In step 550, one of the cells distal to the proximal cell 525 (here cell 515) may be inflated while the proximal cell 525 remains in a deflated state and cells 505-510 remain inflated. In step 535, the second cell distal to the proximal cell 525 (here cell 520) may be inflated while the proximal cell 525 remains in a deflated state and cells 505-515 remain inflated. All cells 505-525 may be deflated in step 540. In some embodiments, the steps of 530, 555, 550, and 535 may be repeated in sequence a plurality of times.

Each step 530, 555, 550, and 535 may be active for a particular duration specified by the compression therapy protocol 500. In some embodiments, each step 530, 555, 550, and 535 may last for the same duration. In some embodiments, one or more steps 530, 555, 550, and 535 may last for different durations. In one embodiment, step 555 may occur immediately after step 530. In one embodiment, step 550 may occur immediately after step 555. In one embodiment, step 535 may occur immediately after step 550. In one embodiment, step 530 may occur immediately after step 535. Any one or more of steps 530, 555, 550, and 535 may be held for some period of time before a succeeding step occurs. The time between steps may be programmed into the controller 245 or may be chosen by a health care worker at the time therapy occurs. In some non-limiting examples, a hold time between steps may be about 0 seconds to about 20 seconds. Non-limiting examples of a hold time between steps may be about 0 seconds, 5 seconds, 10 seconds, 15 seconds, 20 seconds, or any value between any two of these values (including endpoints). The steps 530, 555, 550, and 535 may be active for any duration capable of operating according to some embodiments described herein. With respect to FIG. 5E, a cycle may be defined as a sequence of step 530 followed, sequentially, by step 555, step 555, and step 535. Such a cycle may be repeated once, twice, 3 times, 5 times, 8 times, 10 times, 12 times, or any number of times in a range between any two of these values (including endpoints). A cycle rest time may be defined as a time between cycles. In some non-limiting examples, a cycle rest time may last for about 2 seconds to about 20 seconds. Non-limiting examples of a cycle rest time may be about 0 seconds, 5 seconds, 10 seconds, 15 seconds, 20 seconds, or any value between any two of these values (including endpoints). In some embodiments, all of the cells 505-525 may be deflated 540 for a duration after the completion of the compression therapy protocol.

In step 530, the independently inflatable cells 505-525 may all be inflated to attain about the same pressure. Alternatively, each of the independently inflatable cells 505-525 may be inflated to an independently chosen pressure. In one non-limiting embodiment, the independently inflatable cells 505-525 may be inflated to provide a pressure gradient along the body part (for example, from a distal portion such as an ankle to a proximal portion such as the abdomen). In one non-limiting example, distal cell 505 may be inflated to a pressure of about 50 mmHg (6.67 kPa), cell 510 may be inflated to a pressure of about 45 mmHg (6.0 kPa), cell 515 may be inflated to a pressure of about 40 mmHg (5.33 kPa), cell 520 may be inflated to a pressure of about 35 mmHg (4.67 kPa), and proximal cell 525 may be inflated to a pressure of about 30 mmHg (4.0 kPa).

FIG. 5F depicts a compression therapy protocol 500 that includes two cycles 530, 555. In cycle 530 two cells distal to the proximal cell may be deflated while the remaining cells are maintained at their inflation pressures. As disclosed above, with respect to FIG. 5E, the two cells distal to the proximal cell 525 may include any cell distal to the proximal cell, and are not limited to one or more cells immediately distal to the proximal cell 525. As one non-limiting example, depicted in FIG. 5E, proximal cell 525 and medial cells 515 and 520 (both being distal to the proximal cell) may be deflated, while cells 505-510 remain in an inflated state. In some embodiments, the sequential steps 530 and 555 may be repeated multiple times.

Each step 530, 555 may be active for a particular duration specified by the compression therapy protocol 500. In some embodiments, each step 530, 555 may last for the same duration. In some embodiments, one or more steps 530, 555 may last for different durations. In one embodiment, step 555 may occur immediately after step 530. In one embodiment, step 530 may occur immediately after step 555. In yet another embodiment, step 530 may be held for some period of time before step 555 occurs. In yet another embodiment, step 555 may be held for some period of time before step 540 occurs. The time between steps may be programmed into the controller 245 or may be chosen by a health care worker at the time therapy occurs. In some non-limiting examples, a hold time between steps may be about 0 seconds to about 20 seconds. Non-limiting examples of a hold time between steps may be about 0 seconds, 5 seconds, 10 seconds, 15 seconds, 20 seconds, or any value between any two of these values (including endpoints). The steps 530, 555 may be active for any duration capable of operating according to some embodiments described herein. With respect to FIG. 5F, a cycle may be defined as a sequence of step 530 followed by step 555. Such a cycle may be repeated once, twice, 3 times, 5 times, 8 times, 10 times, 12 times, or any number of times in a range between any two of these values (including endpoints). A cycle rest time may be defined as a time between cycles. In some non-limiting examples, a cycle rest time may last for about 2 seconds to about 20 seconds. Non-limiting examples of a cycle rest time may be about 0 seconds, 5 seconds, 10 seconds, 15 seconds, 20 seconds, or any value between any two of these values (including endpoints). In some embodiments, each step 530, 555 may be followed by a hold time before the compression therapy device activates the next step. In some embodiments, all of the cells 505-525 may be deflated 540 for a duration after the completion of the compression therapy protocol.

It may be understood that the protocols illustrated in FIGS. 5A-5F represent a few non-limiting examples of possible inflation/deflation protocols that may be used to provide fluid decongestion as part of an overall compression therapy program. Other protocols may include more or fewer cells and a variety of sequences of inflation and deflation. Although the protocols 500 depicted in FIGS. 5A-5F illustrate particular steps in specific sequential orders, embodiments are not so limited.

In some embodiments, the protocols 500 depicted in FIGS. 5A-5F may be modified to accommodate a compression therapy appliance having more or fewer cells than depicted in FIGS. 5A-5F. In a first non-limiting example, for a three-cell compression therapy appliance having three cells 1-3 with 1 being at the distal end of the appliance and 3 being at the proximal end of the appliance may be configured such that cell 1 operates as the distal cell, cell 3 operates as the proximal cell, and cell 2 operates as a medial cell. In a second non-limiting example, a seven-cell compression therapy appliance having seven cells 1-7 with 1 being at the distal end of the appliance and 7 being at the proximal end of the appliance. In some non-limiting embodiments, an appliance may have about 2 independently inflatable cells to about 40 independently inflatable cells. Non-limiting examples may include an appliance having about 2 cells, about 4 cells, about 6 cells, about 8 cells, about 10 cells, about 20 cells, about 30 cells, about 40 cells, or a number of cells in a range between any two of these values (including endpoints). In some embodiments, a single proximal cell and a single distal cell may be identified. In other embodiments, more than one cell may functionally operate in concert as a proximal cell. In other embodiments, more than one cell may functionally operate in concert as a distal cell. Medial cells identified between the proximal cell and the distal cell may be inflated, maintained, and deflated independently. Alternatively, groups of medial cells identified between the proximal cell and the distal cell may be inflated, maintained, and deflated functionally in concert.

It may be understood that fluid decongesting compression therapy protocols as illustrated in FIGS. 5A-5F may be followed by one or more additional compression therapy protocols. FIG. 5G illustrates an example of a typical gradient compression therapy protocol 500 that may be used for a patient after the patient has undergone a decongesting protocol. It may be observed that the gradient protocol may begin with all cells 505-525 in a deflated state 540. Thereafter, each cell, in a distal (505) to proximal (525) order, may be inflated and held at a final pressure, as illustrated by steps 540, 560, 555, 550, 535, and 530, respectively. As disclosed above, the final pressure attained by each cell may be the same among all the cells or may differ among all the cells. In some examples, the final pressure attained by a cell may be greater than that of a cell proximal to it and less than that of a cell distal to it. As disclosed above, each step may be followed immediately by a subsequent step or there may be a delay time between subsequent steps. Delay times between steps may be the same for each step, or may differ between any two steps.

More complex compression therapy protocols may include feedback from the individual cells to the controller 245 before, during, and/or after inflation or deflation. In one non-limiting example, the controller 245 may monitor the pressure of a cell after it has stopped inflating or deflating to assure the cell pressure is maintained while the cell is in a hold state (neither inflating nor deflating). Thus, the pressure measured by a pressure sensor 255*a* associated with a first cell may change due to effects on the tissue brought about by the inflation of a neighboring cell. The controller 245 may respond to the change in pressure in the first cell by activating its associated valve 225*a* to adjust the first cell pressure to a desired value.

In another protocol, the controller 245 may retain or have access to historical patient information, such as logs associated with the patient's medical history over time. Such historical patient information may be used by the controller 245 and/or a health care professional to modify a protocol to account for a change in the patient's status. As one non-limiting example, the controller 245 may alter a patient's usual compression therapy protocol if the long term patient status—as recorded in the patient logs—indicates an improvement over time. Alternatively, if the patient does not improve, the controller 245 may alter the usual patient's protocol in an attempt to improve its effectiveness. A health care provider may also be presented with such long term status information along with a recommendation for a protocol change by the controller 245. The health care provider may then accept the recommendation by the controller 245 and/or may make additional modifications.

The present disclosure is not to be limited in terms of the particular embodiments described in this application, which are intended as illustrations of various aspects. Many modifications and variations can be made without departing from its spirit and scope, as will be apparent to those skilled in the art. Functionally equivalent methods and apparatuses within the scope of the disclosure, in addition to those enumerated herein, will be apparent to those skilled in the art from the foregoing descriptions. Such modifications and variations are intended to fall within the scope of the appended claims. The present disclosure is to be limited only by the terms of the appended claims, along with the full scope of equivalents to which such claims are entitled. It is to be understood that this disclosure is not limited to particular methods, reagents, compounds, compositions or biological systems, which can, of course, vary. It is also to be understood that the terminology used herein is for the purpose of describing particular embodiments only, and is not intended to be limiting.

With respect to the use of substantially any plural and/or singular terms herein, those having skill in the art can translate from the plural to the singular and/or from the singular to the plural as is appropriate to the context and/or application. The various singular/plural permutations may be expressly set forth herein for sake of clarity.

It will be understood by those within the art that, in general, terms used herein, and especially in the appended claims (e.g., bodies of the appended claims) are generally intended as "open" terms (e.g., the term "including" should be interpreted as "including but not limited to," the term "having" should be interpreted as "having at least," the term "includes" should be interpreted as "includes but is not limited to," etc.). It will be further understood by those within the art that if a specific number of an introduced claim recitation is intended, such an intent will be explicitly recited in the claim, and in the absence of such recitation no such intent is present. For example, as an aid to understanding, the following appended claims may contain usage of the introductory phrases "at least one" and "one or more" to introduce claim recitations. However, the use of such phrases should not be construed to imply that the introduction of a claim recitation by the indefinite articles "a" or "an" limits any particular claim containing such introduced claim recitation to embodiments containing only one such recitation, even when the same claim includes the introductory phrases "one or more" or "at least one" and indefinite articles such as "a" or "an" (e.g., "a" and/or "an" should be interpreted to mean "at least one" or "one or more"); the same holds true for the use of definite articles used to introduce claim recitations. In addition, even if a specific number of an introduced claim recitation is explicitly recited, those skilled in the art will recognize that such recitation should be interpreted to mean at least the recited number (e.g., the bare recitation of "two recitations," without other modifiers, means at least two recitations, or two or more recitations). Furthermore, in those instances where a convention analogous to "at least one of A, B, and C, etc." is used, in general such a construction is intended in the sense one having skill in the art would understand the convention (e.g., "a system having at least one of A, B, and C" would include but not be limited to systems that have A alone, B alone, C alone, A and B together, A and C together, B and C together, and/or A, B, and C together, etc.). In those instances where a convention analogous to "at least one of A, B, or C, etc." is used, in general such a construction is intended in the sense one having skill in the art would understand the convention (e.g., "a system having at least one of A, B, or C" would include but not be limited to systems that have A alone, B alone, C alone, A and B together, A and C together, B and C together, and/or A, B, and C together, etc.). It will be further understood by those within the art that virtually any disjunctive word and/or phrase presenting two or more alternative terms, whether in the description, claims, or drawings, should be understood to contemplate the possibilities of including one of the terms, either of the terms, or both terms. For example, the phrase "A or B" will be understood to include the possibilities of "A" or "B" or "A and B."

As will also be understood by one skilled in the art all language such as "up to," "at least," and the like include the number recited and refer to ranges which can be subsequently broken down into subranges as discussed above. Finally, as will be understood by one skilled in the art, a range includes each individual member. Thus, for example, a group having 1-3 cells refers to groups having 1, 2, or 3 cells. Similarly, a group having 1-5 cells refers to groups having 1, 2, 3, 4, or 5 cells, and so forth.

Various of the above-disclosed and other features and functions, or alternatives thereof, may be combined into many other different systems or applications. Various presently unforeseen or unanticipated alternatives, modifications, variations or improvements therein may be subsequently made by those skilled in the art, each of which is also intended to be encompassed by the disclosed embodiments.

What is claimed is:

1. A compression therapy device comprising:

a source of a pressurized fluid via a source output;

a sink for the pressurized fluid via a sink input;

one or more manifolds, configured to be in fluid communication with one or more of the source output and the sink input;

a compression therapy appliance configured to be placed in physical communication with at least a portion of a patient, wherein the compression therapy appliance comprises a plurality of independently inflatable cells, and wherein the plurality of independently inflatable cells comprises at least one proximal cell and at least one cell distal to the at least one proximal cell;

a plurality valves operatively linked to the independently inflatable cells, wherein each valve in the plurality of valves has a cell side and a manifold side, wherein the manifold side of each of the plurality of valves is in fluid communication with at least one manifold, wherein the cell side of each of the plurality of valves is in fluid communication with one of the plurality of independently inflatable cells;

wherein each of the plurality of valves is in a first state when the cell side of the valve is in fluid communication with the source output, thereby inflating the inflatable cell in fluid communication with the valve, wherein each of the plurality of valves is in a second state when the cell side of the valve is in fluid communication with the sink input, thereby deflating the inflatable cell in fluid communication with the valve, and wherein each of the plurality of valves is in a third state when the cell side of the valve is not in fluid communication with either the source output or the sink input, thereby maintaining a fluid pressure of the inflatable cell in fluid communication with the valve; and a computing device in operable communication with each of the plurality of valves, wherein the computing device comprises a non-transitory, computer-readable storage medium, wherein the non-transitory, computer-readable storage medium contains one or more programming instructions that, when executed, cause the computing device to:

simultaneously place each of the plurality of valves in the first state for a first period of time, thereby inflating each of the plurality of inflatable cells, place each of the plurality of valves in the third state for a second period of time, thereby maintaining a fluid pressure in each of the plurality of inflatable cells, place each of the plurality of valves in fluid communication with the at least one proximal cell in the second state, thereby deflating the at least one proximal cell, place each of the plurality of valves in fluid communication with the at least one cell distal to the at least one proximal cell in the second state, thereby deflating the at least one cell distal to the at least one proximal cell at the same time as the at least one proximal cell, cycle the state of each of the plurality of valves in fluid communication with the at least one proximal cell between the first state and the second state, thereby sequentially inflating and deflating the at least one proximal cell, and cycle the state of each of the plurality of valves in fluid communication with the at least one cell distal to the at least one proximal cell between the first state and the second state, thereby sequentially inflating and deflating the at least one cell distal to the at least one proximal cell, wherein the at least one proximal cell and the at least one cell distal to the at least one proximal cell deflate at the same time, wherein the at least one cell distal to the at least one proximal cell inflates after the at least one proximal cell and the at least one cell distal to the at least one proximal cell deflate, and wherein the at least one proximal cell inflates after the at least one cell distal to the at least one proximal cell inflates.

2. A method of treating a portion of a human body for an edematous condition using a compression therapy device, the method comprising:

providing a compression therapy device comprising a compression therapy appliance, wherein the compression therapy appliance comprises a plurality of valves operatively linked to a plurality of independently inflatable cells, the plurality of independently inflatable cells comprising at least one proximal cell and at least one cell distal to the at least one proximal cell;

contacting the compression therapy appliance with the portion of the human body, whereby the at least one proximal cell is adjacent to a proximal portion of the human body;

simultaneously placing each of the plurality of valves in an inflating state for a first period of time thereby inflating each cell of the plurality of independently inflatable cells to an inflated state;

placing each of the plurality of valves in a maintaining state for a second period of time to maintain the inflated state;

causing, by the compression therapy device, the at least one proximal cell to cycle between the inflated state and a deflated state; and causing, by the compression therapy device, the at least one cell distal to the at least one proximal cell to cycle between the inflated state and the deflated state such that:

the at least one proximal cell and the at least one cell distal to the at least one proximal cell deflate at the same time, the at least one cell distal to the at least one proximal cell inflates after the at least one proximal cell and the at least one cell distal to the at least one proximal cell deflate, and the at least one proximal cell inflates after the at least one cell distal to the at least one proximal cell inflates.

3. The method of claim 2, wherein the portion of the human body comprises one or more of a torso, an abdomen, a shoulder, an arm, an upper arm, a hip, a leg, a thigh, and a knee.

4. The method of claim 2, wherein the portion of the human body comprises at least an arm.

5. The method of claim 2, wherein the portion of the human body comprises at least a leg.

6. The method of claim 2, wherein the edematous condition comprises one or more of lymphedema, venous insufficiency, an athletic soft tissue injury, venous return deficiency, and arterial output insufficiencies.

7. The method of claim 2, wherein the plurality of independently inflatable cells comprises 2 cells to 40 cells.

8. The method of claim 2, wherein the portion of the human body comprises an arm and a shoulder, and the proximal portion of the human body comprises one or more of an upper arm and the shoulder.

9. The method of claim 2, wherein the portion of the human body comprises a leg and a hip and the proximal portion of the human body comprises one or more of an upper thigh, a groin, an abdomen, and the hip.

10. The method of claim 2, wherein the portion of the human body comprises a torso and the proximal portion of the human body comprises an abdomen.

11. The method of claim 2, wherein simultaneously placing each of the plurality of valves in an inflating state for a first period of time thereby inflating each cell of the plurality of independently inflatable cells to an inflated state comprises inflating each of the plurality of independently inflatable cells to a pressure of 5 mmHg to 150 mmHg.

12. The method of claim 2, wherein causing the at least one proximal cell to cycle between the inflated state and a deflated state comprises cycling the at least one proximal cell between the inflated state and the deflated state one time to twelve times.

13. The method of claim 2, wherein causing the at least one proximal cell to cycle between the inflated state and a deflated state comprises cycling the at least one proximal cell between the inflated state and the deflated state twelve times.

14. The method of claim 2, wherein causing the at least one proximal cell to cycle between the inflated state and a deflated state comprises inflating the at least one proximal cell and deflating the at least one proximal cell after the at least one proximal cell has attained a maximum pressure.

15. The method of claim 2, wherein causing the at least one proximal cell to cycle between the inflated state and a deflated state comprises inflating the at least one proximal cell and deflating the at least one proximal cell after holding the at least one proximal cell at a maximum pressure for a period of time.

16. The method of claim 2, further comprising causing, by the compression therapy device, the plurality of independently inflatable cells to assume the deflated state.

17. The method of claim 2, wherein an independently inflatable cell in the deflated state comprises the independently inflatable cell having a pressure of atmospheric pressure.

* * * * *